US006193015B1

(12) United States Patent
Kato et al.

(10) Patent No.: US 6,193,015 B1
(45) Date of Patent: Feb. 27, 2001

(54) STRUCTURE TO JOIN CYLINDER LIFTING CARGO-HANDLING TOOL

(75) Inventors: Yoshiichi Kato; Yuji Odamura, both of Tokyo (JP)

(73) Assignee: Nissan Motor Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/143,518

(22) Filed: Aug. 28, 1998

(30) Foreign Application Priority Data

Aug. 28, 1997 (JP) ..... 9-232982

(51) Int. Cl.[7] ..... B66F 9/06
(52) U.S. Cl. ..... 187/226
(58) Field of Search ..... 187/226, 229, 187/230, 234

(56) References Cited

U.S. PATENT DOCUMENTS 2,973,835 * 3/1961 Quayle ..... 187/226
3,671,000 * 6/1972 Williams ..... 248/205
3,709,393 * 1/1973 McGehee ..... 187/226
4,029,276 * 6/1977 Zielie ..... 248/74.1
4,366,922 * 1/1983 Levine et al. ..... 248/221.3
4,476,960 * 10/1984 Yarris ..... 187/226
4,503,935 * 3/1985 Haffer et al. ..... 187/229
4,555,083 * 11/1985 Carter ..... 248/313
4,629,153 * 12/1986 Marcum ..... 248/558

FOREIGN PATENT DOCUMENTS 57-155198 9/1982 (JP) .
59-123096 8/1984 (JP) .

* cited by examiner

*Primary Examiner*—Robert P. Olszewski
*Assistant Examiner*—Steven B. McAllister
(74) *Attorney, Agent, or Firm*—McDermott, Will & Emery

(57) ABSTRACT

A structure to join a cylinder lifting a cargo-handling tool includes a pair of masts provided on a forklift truck; a pair of second masts vertically moved by mast lifting cylinder disposed adjacent to the first masts; a cargo-handling tool vertically moved with respect to the pair of the second masts by cargo-handling-tool lifting cylinders disposed adjacent to the second masts; a connecting member connecting the pair of the second masts to each other in the rear portion of the forklift truck; and brackets joining the cylinders to the connecting member. In the construction, the cylinders are disposed in the rear of the pair of the second masts; ends of the brackets are joined and secured to the connecting member through joint portions in a state in which the cylinders are supported by the brackets at adjacent positions by the connecting member; and the joint portions are formed in front of the cylinders.

4 Claims, 20 Drawing Sheets

PRIOR ART

STRUCTURE TO JOIN CYLINDER LIFTING CARGO-HANDLING TOOL

BACKGROUND OF THE INVENTION

1. Field of the Invention

The present invention relates to a structure to join a cylinder lifting a cargo-handling tool, more specifically to a structure to join a cylinder which is joined to a connecting member which connects a pair of right-hand and left-hand second masts to each other, and which is used for vertically moving the cargo-handling tool provided on the pair of right-hand and left-hand second masts being vertically moved with respect to a pair of right-hand and left-hand first masts provided on a forklift truck 2. Description of the Related Art Cargo-lifting mechanisms of a type having a structure as schematically shown in FIG. 1 are known, that is, a cargo-lifting mechanism having three pairs of masts provided with a free lift. The foregoing lifting mechanism incorporates a pair of right-hand and left-hand (in a direction perpendicular to the surface of a drawing sheet) outer masts 1 secured to a front portion of the forklift truck. A pair of right-hand and left-hand middle masts 3 are provided for the outer masts 1 such that vertical movement of the middle masts 3 is permitted. Moreover, a pair of right-hand and left-hand inner masts 5, which are capable of moving vertically, are provided for the middle masts 3. The inner masts 5 are provided with a fork 7 serving as a cargo-handling tool on which a cargo is placed such that vertical movement of the fork 7 is permitted.

A cargo-handling-tool lifting cylinder (a full-free cylinder) 9 for vertically moving the fork 7 is secured to a position adjacent to the inner masts 5. The fork 7 and the inner masts 5 are connected to each other by dint of a chain 15 through a chain sprocket 13 disposed at the top end of a cylinder rod 11 of the cargo-handling-tool lifting cylinder 9. When the cargo-handling-tool lifting cylinder 9 is operated, the fork 7 is vertically moved with respect to the inner masts 5.

On the other hand, mast-lifting cylinders 17 for vertically moving the middle masts 3 and the inner masts 5 are disposed at positions adjacent to the outer masts 1. The outer masts 1 and the inner masts 5 are connected to each other by dint of a chain 21 through chain sprockets 19 disposed on the upper portions of the middle masts 3. When the middle masts 3 are moved vertically because of the operation of the mast-lifting cylinders 17, the inner masts 5 are moved vertically with respect to the outer masts 1 for a distance that is twice that of the middle masts 3 is vertically moved.

FIG. 2 is a plan view showing a specific structure of the above-mentioned lifting mechanism. The lower ends of the pairs of the right-hand and the left-hand outer masts 1, middle masts 3 and the inner masts 5 are connected to each other by an outer-mast lower beam 23, a middle-mast lower beam 25 and an inner-mast lower beam 27. The pair of right-hand and left-hand mast-lifting cylinders 17 for vertically moving the middle masts 3 are elongated vertically on the outer-mast lower beam 23 disposed in the rear of the outer masts 1. On the other hand, the cargo-handling-tool lifting cylinder 9 for upwardly moving the fork 7 is elongated vertically on a cylinder support 29 which is disposed between the right-hand and left-hand inner masts 5 and which forwards projects over the inner-mast lower beam 27.

The fork 7 is joined to the front surface of a carriage 33 secured to the leading ends of a pair of carriage brackets 31 disposed on the inside of the inner masts 5. Mast rollers 35 are joined to the side surfaces of the upper and lower ends of the carriage brackets 31. When the mast rollers 35 vertically roll with respect to the inner masts 5, the carriage brackets 31, the carriage 33 and the fork 7 are vertically moved with respect to the inner masts 5. Mast rollers (not shown in FIG. 2) are disposed between the outer masts 1 and the middle masts 3 and between the middle masts 3 and the inner masts 5 (for example, mast rollers 36 are disposed in the lower portions of the inner masts 5 as shown in FIG. 3 to be described later).

Lift-mechanism support brackets 37 for mounting the foregoing lifting mechanism on the forklift truck (a front axle shaft) are disposed at the right and left ends of the outer-mast lower beam 23. The distance from the joining center of each of the lift-mechanism support brackets 37 to the carriage 33 is a front overhang (FOH). When the FOH is reduced, the distance from the forklift truck to a portion for holding a cargo can be shortened. Thus, a cargo-handling operation can stably be performed.

FIG. 3 is a perspective view showing the inner masts 5 and the cargo-handling-tool lifting cylinder 9 which is joined to the inner masts 5. A threaded hole 29*a* is formed in the upper surface of the cylinder support 29 provided for the inner-mast lower beam 27. A bolt 39 is screwed in the threaded hole 29*a*. On the other hand, a locating recess 9*a* into which the head of the bolt 39 is introduced is formed in the lower surface of the cargo-handling-tool lifting cylinder 9.

In a state in which the locating recess 9*a* of the cargo-handling-tool lifting cylinder 9 is received by the head of the bolt 39 jointed to the upper surface of the cylinder support 29, brackets 41 disposed at positions relatively upper than the central portion of the cargo-handling-tool lifting cylinder 9 are secured to a center beam 43 with two bolts 45, the center beam 43 establishing the connection between intermediate portions of the inner masts 5 in the vertical direction. Thus, the cargo-handling-tool lifting cylinder 9 is joined to a position adjacent to the inner masts 5.

FIG. 4 shows an example in which two cargo-handling-tool lifting cylinders 9 are employed. The cylinders 9 are disposed at positions adjacent to the right and left inner masts 5. In the foregoing example, pins 47 disposed on a cylinder support 29 are received by recesses 9*a* formed in the lower surface of the cargo-handling-tool lifting cylinder 9. In the foregoing state, brackets 41 provided for the cargo-handling-tool lifting cylinder 9 are secured to the center beam 43 with bolts 45.

The example of the structure for joining a cylinder for lifting a cargo-handling tool of the type shown in FIG. 3 has the arrangement that the cargo-handling-tool lifting cylinder 9 is disposed at an intermediate position between the right and left inner masts 5. Therefore, forward visibility is unsatisfactory for an operator of the forklift truck to efficiently perform the cargo handling operation. The example shown in FIG. 4 incorporates the two cargo-handling-tool lifting cylinders 9 disposed at the right and left positions. Therefore, the forward visibility is improved as compared with the example shown in FIG. 3. However, the cargo-handling-tool lifting cylinders 9 are disposed between the carriage brackets 31 shown in FIG. 2. Therefore, the visibility for the forklift operator is obstructed. Thus, further improvement in the visibility is required.

To improve the forward visibility, a structure is disclosed in Japanese Utility-Model Applications Laid-Open No. 57-155198 and Laid-Open No. 59-123096. The structure is formed such that cargo-handling-tool lifting cylinders 9 are disposed adjacently to inner masts 5 at positions in the rear of the inner masts 5.

When the cargo-handling-tool lifting cylinders 9 are disposed adjacently to the inner masts 5 at positions in the rear of the inner masts 5, a structure may be employed in which brackets 41 for securing the cargo-handling-tool lifting cylinders 9 are, as shown in FIG. 5 which is a plan view, secured to the center beam 43 by dint of bolts 45 from front positions of the forklift truck. To improve the forward visibility by disposing the cargo-handling-tool lifting cylinders 9 at further outer positions in the widthwise direction of the forklift truck, heads of the bolts 45 interfere with the inner masts 5. Therefore, satisfactorily improved forward visibility cannot be obtained.

To reduce the front overhang (FOH), the cargo-handling-tool lifting cylinders 9 must be disposed at positions closer to the center beam 43. If the distance is too short, the leading end of the bolts 45 screwed in the brackets 41 interfere with the cargo-handling-tool lifting cylinders 9. To prevent the interference, the distance between the two bolts 45 must be elongated. Moreover, the cargo-handling-tool lifting cylinders 9 must be disposed closer to the central portion. If the distance between the bolts 45 is elongated, the size of each of the brackets 41 is enlarged excessively to easily handle the brackets 41. What is worse, the forward visibility deteriorates. As a matter of course, the forward visibility deteriorates if the cargo-handling-tool lifting cylinders 9 is disposed adjacent to the central portion.

The above-mentioned structure in which the cargo-handling-tool lifting cylinders 9 disposed adjacent to the inner masts 5 and in the rear of the inner masts 5 is secured from the front positions of the forklift truck with the bolts 45 cannot permit a satisfactorily wide forward visibility to be obtained. If the cargo-handling-tool lifting cylinders 9 are disposed closer to the center beam 43 in order to satisfy the FOH, the forward visibility furthermore deteriorates. Therefore, an improvement is required.

SUMMARY OF THE INVENTION

The present invention has been achieved with such points in mind.

It therefore is an object of the present invention to provide a structure to join a cylinder that lifts a cargo-handling tool such that forward visibility is improved by disposing the cylinders that lift the cargo-handling tool at two positions, which are located apart from each other in the direction toward each outer end in the rear of the inner masts respectively, and wherein a front overhang thereof is reduced.

To achieve the above-mentioned object, according to an aspect of the present invention, there is provided a structure to join a cylinder lifting a cargo-handling tool, comprising: a pair of right-hand and left-hand first masts provided on a forklift truck;

a pair of right-hand and left-hand second masts vertically moved by mast lifting cylinder disposed adjacent to the first masts; a cargo-handling tool vertically moved with respect to the pair of the right-hand and left-hand second masts by cargo-handling-tool lifting cylinders disposed adjacent to the second masts; a connecting member connecting the pair of the second masts to each other in the rear portion of the forklift truck; and brackets joining the cargo-handling-tool lifting cylinders to the connecting member, wherein the cargo-handling-tool lifting cylinders are disposed in the rear of the pair of the second masts; ends of the brackets are joined and secured to the connecting member through joint portions in a state in which the cargo-handling-tool lifting cylinders are supported by the brackets at adjacent positions by the connecting member; and the joint portions are formed in front of the cargo-handling-tool lifting cylinders.

The structure for joining a cylinder for lifting a cargo-handling tool having the above-mentioned structure is arranged such that the front ends of the brackets provided for the cargo-handling-tool lifting cylinders disposed in the rear of the second masts are secured to the connecting member through the joint portions without any bolt. Moreover, the joint portions are formed in front of the cargo-handling-tool lifting cylinders. Therefore, the necessity of preventing interference of the heads of the bolts with the second masts can be eliminated when the cargo-handling-tool lifting cylinders are disposed at outer positions. Thus, the forward visibility can be improved.

Even if the cargo-handling-tool lifting cylinders are disposed at adjacent positions by the connecting member to reduce the front overhang, interference with the leading ends of the bolts can be prevented. Therefor, a necessity of disposing the cargo-handling-tool lifting cylinders adjacent to the central portion in the widthwise direction of the forklift truck can be eliminated. Thus, deterioration in the forward visibility can be prevented. Since the brackets do not require bolt fixing portions, the length in the widthwise direction of the forklift truck can be reduced. Thus, also the foregoing structure enables the forward visibility to be improved.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
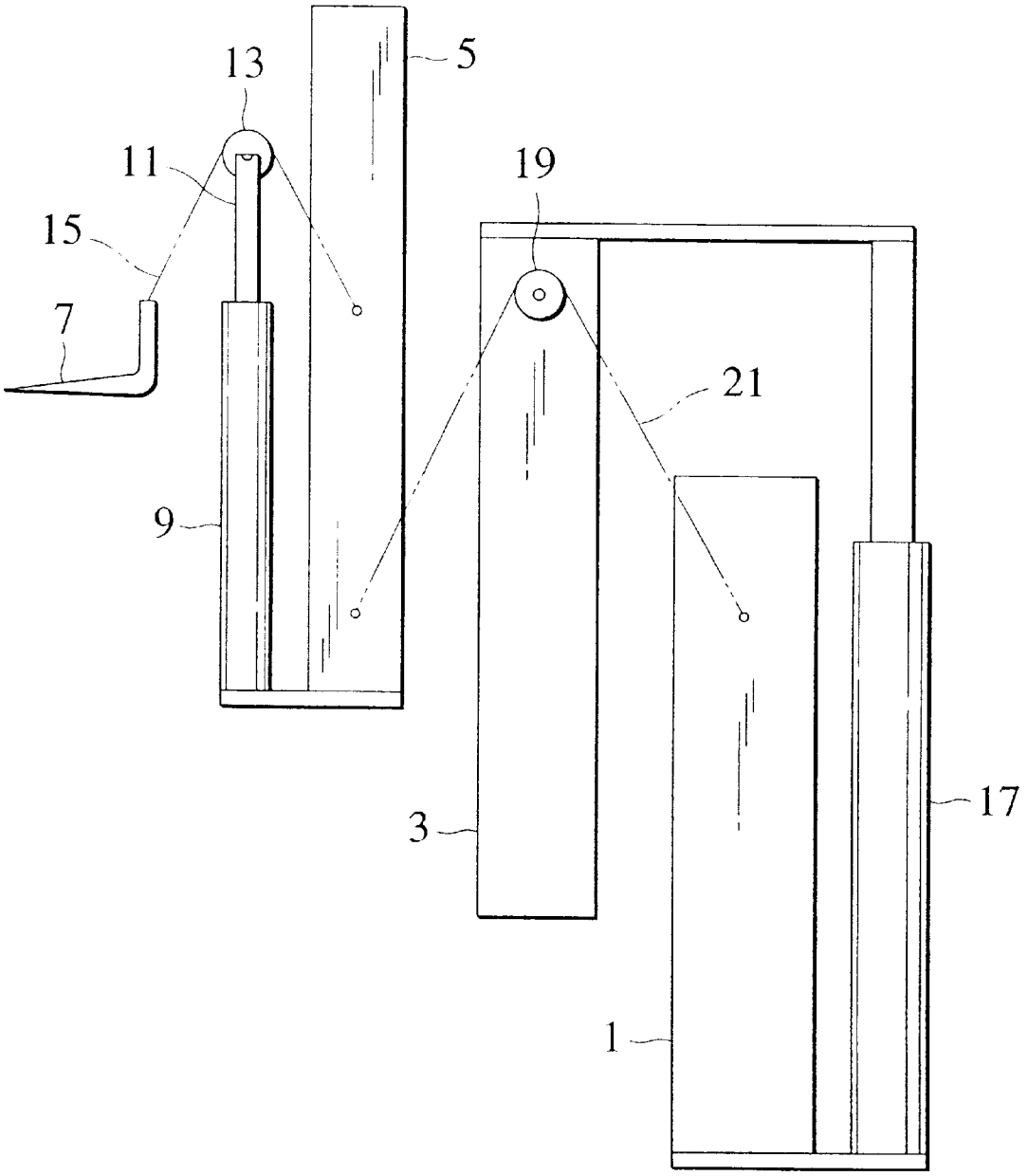
FIG. 1 is a schematic view showing a cargo-lifting mechanism having three pairs of masts provided with a free lift of a forklift truck.
Figure 2:
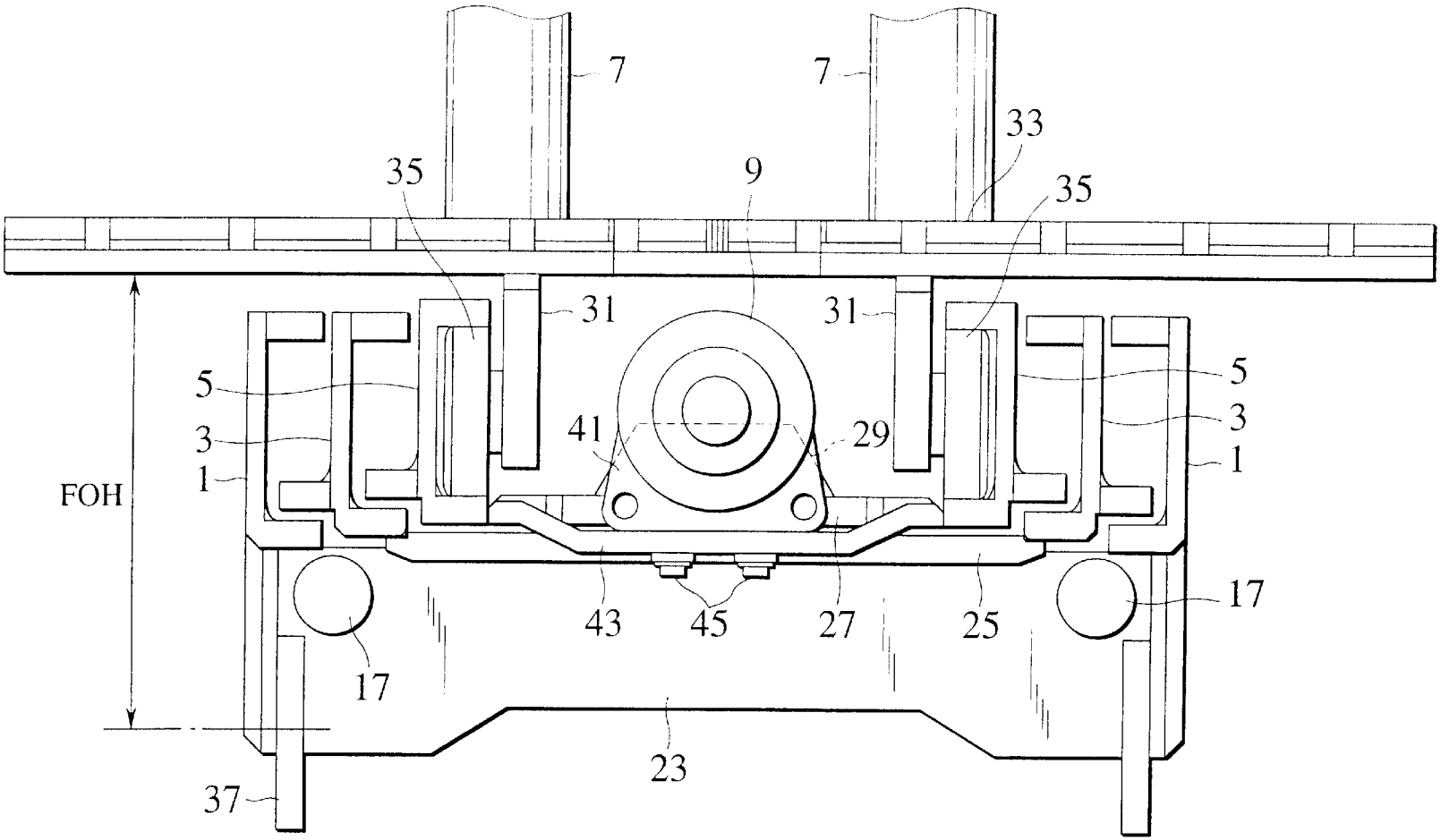
FIG.2 PRIOR ART
FIG. 2 is a schematic plan view showing a lifting mechanism provided with a conventional structure for joining a cylinder for lifting a cargo-handling tool.
Figure 3:
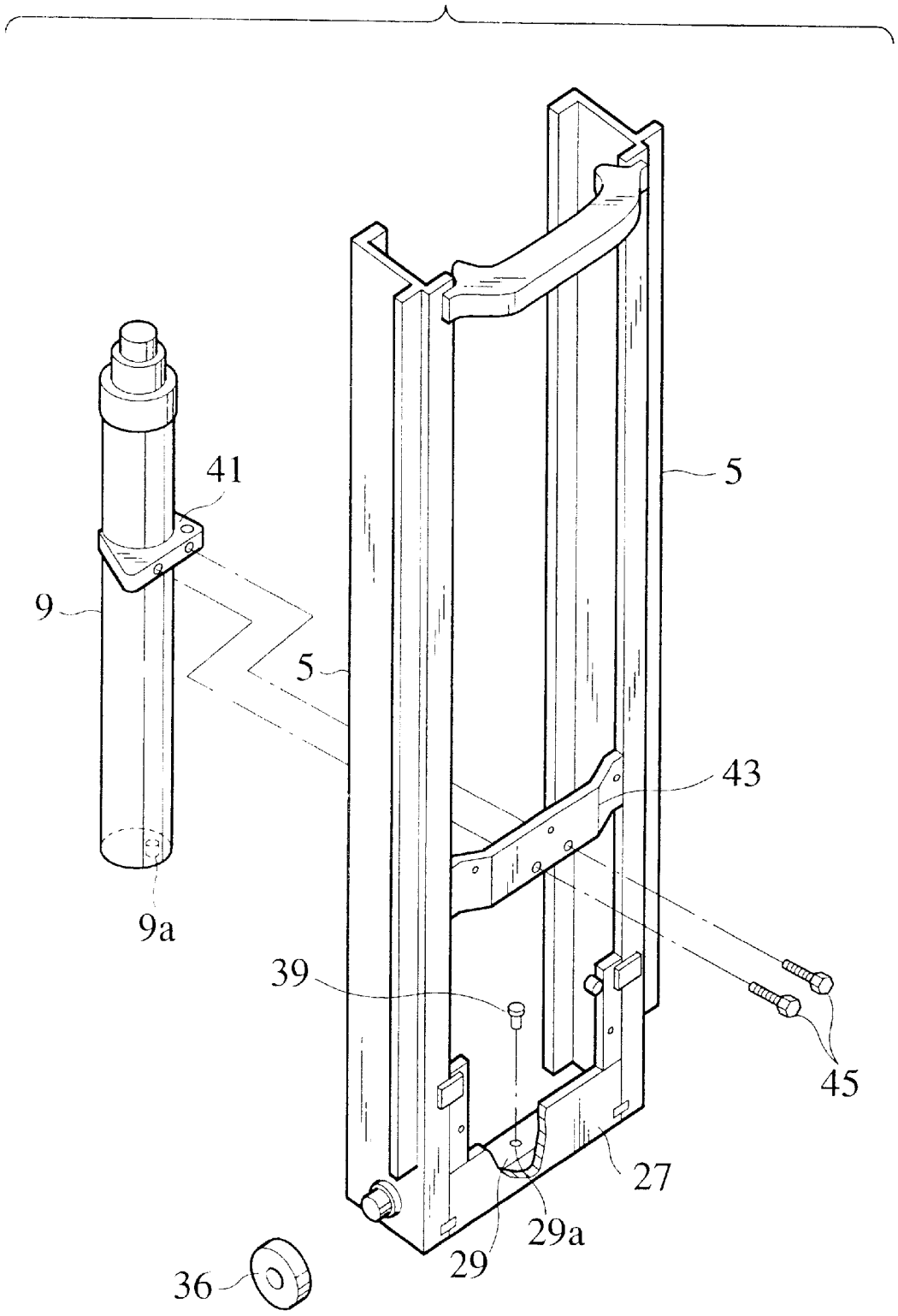
FIG.3 PRIOR ART
FIG. 3 is a perspective view showing inner masts and cargo-handling-tool lifting cylinders joined to the inner masts of the lifting mechanism shown in FIG. 2.
Figure 4:
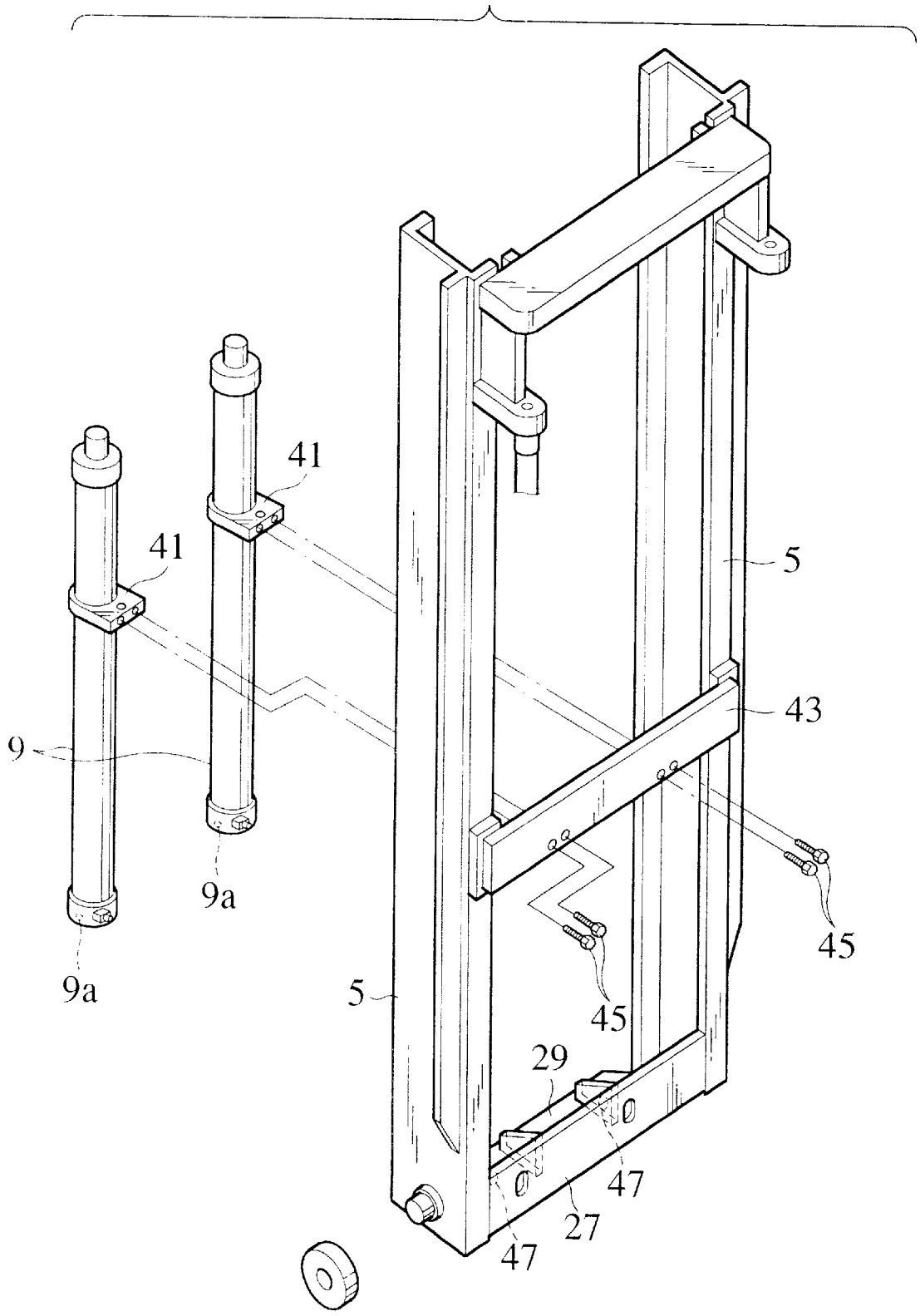
FIG.4 PRIOR ART
FIG. 4 is a perspective view showing a structure in which two cargo-handling-tool lifting cylinders are employed similarly to a structure shown in FIG. 3.

There will be detailed below the preferred embodiments of the present invention with reference to the accompanying drawings. Like members are designated by like reference characters.

Figure 5:
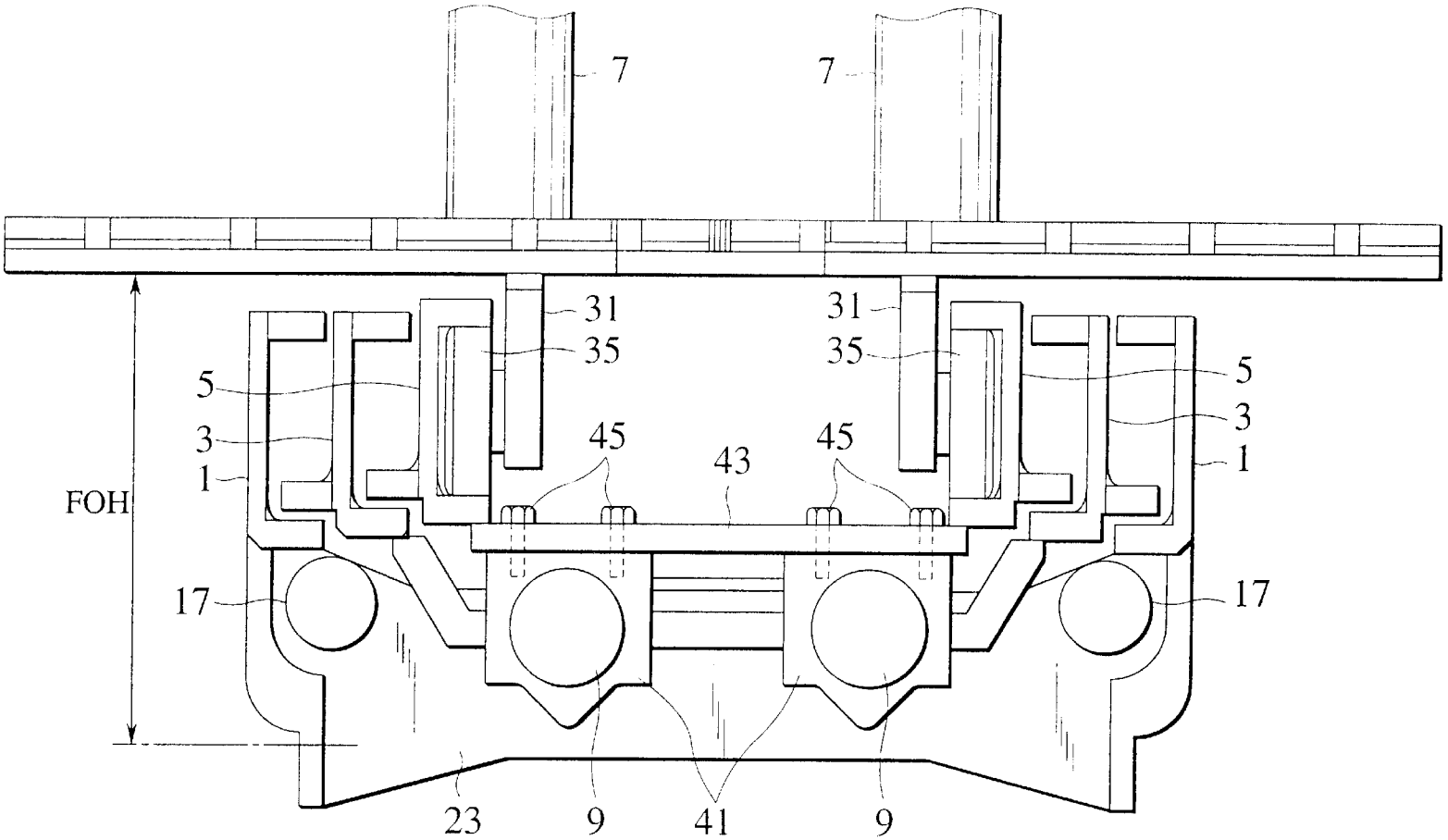
FIG.5 PRIOR ART
FIG. 5 is a plan view showing a structure in which two cargo-handling-tool lifting cylinders are employed similarly to a structure shown in FIG. 2.
Figure 6:
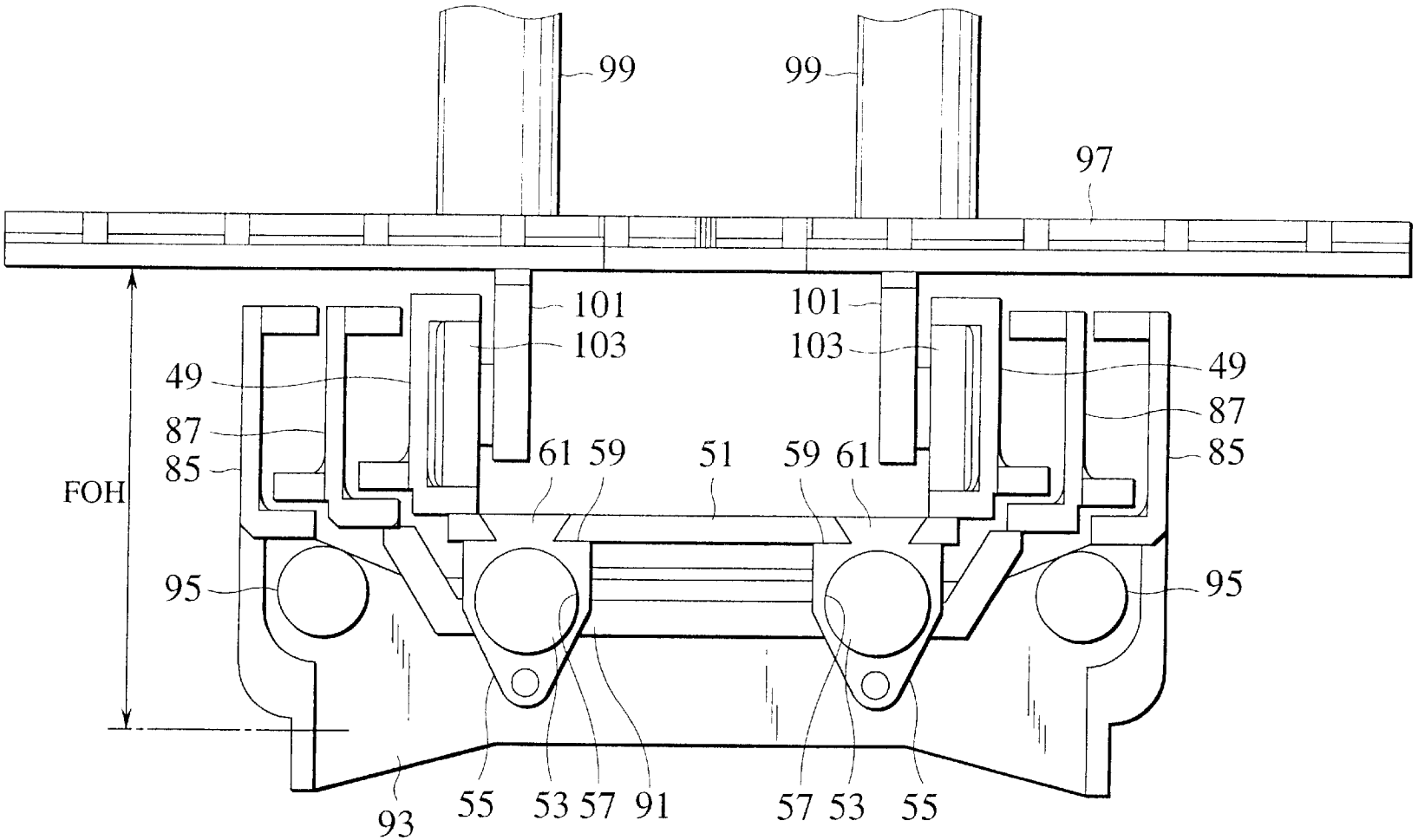
FIG. 6 is a plan view showing the overall structure of a lifting mechanism of a forklift truck according to a first embodiment of the present invention.
Figure 7:
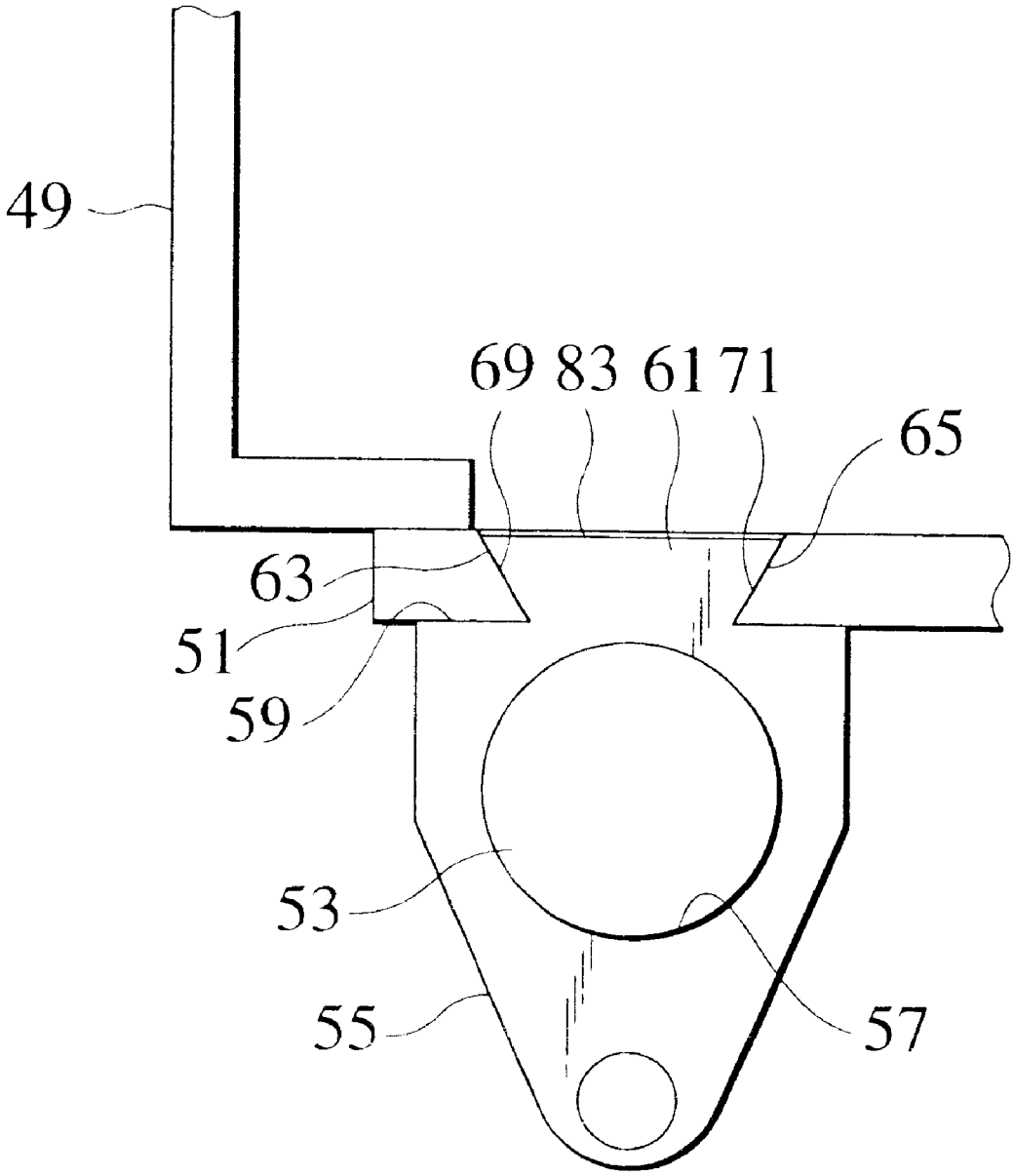
FIG. 7 is an enlarged plan view showing an essential portion of the structure shown in FIG. 6.

FIG. 6 is a plan view showing the overall structure of a lifting mechanism of a forklift truck and corresponding to FIG. 5. FIG. 7 is a plan view showing an essential portion of the lifting mechanism. A center beam 51 serving as a plate-like connecting member for connecting a pair of right-hand and left-hand inner masts 49 is disposed at substantially the vertical center (in a direction perpendicular to a drawing sheet on which FIG. 6 is drawn) of inner masts 49 which are second masts. Cargo-handling-tool lifting cylinders 53 are, through the brackets 55, secured to the center beam 51 at positions in the rear of the right and left inner masts 49.

Figure 8:
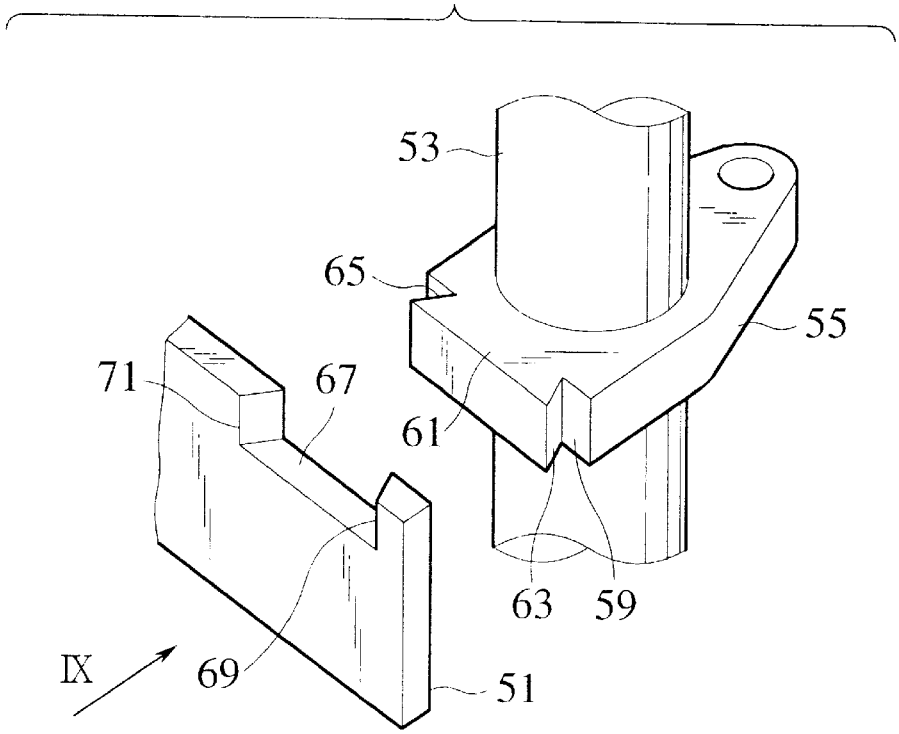
FIG. 8 is an exploded perspective view showing the portion shown in FIG. 7 when it is viewed from a front left portion of the forklift truck.

The brackets 55 have insertion holes 57 into which the cargo-handling-tool lifting cylinders 53 are inserted and supported. Moreover, the brackets 55 each have engaging projections 61 that project forward and have end surfaces 59 that are in close contact with a rear surface of the center beam 51. Each of the engaging projections 61 has a width somewhat smaller than the outer diameter of each of the cargo-handling-tool lifting cylinders 53. The engaging projections 61 are formed in front of the cargo-handling-tool lifting cylinders 53. As shown in FIG. 8 which is an exploded perspective view of a joint portion shown in FIG. 7 when viewed from a front left portion of a forklift truck, the width of a front portion of each of the engaging projections 61 is larger than the width of a rear portion of each of the engaging projections 61. As a result, inclined surfaces 63 and 65 are formed on the two sides of each of the engaging projections 61.

Figure 9:
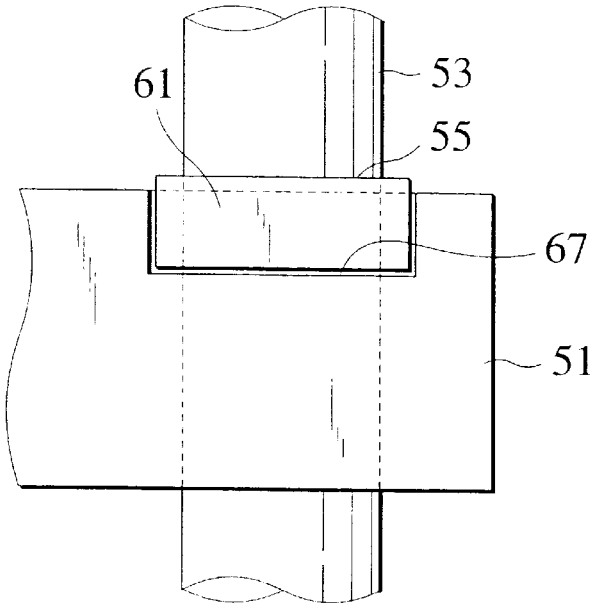
FIG. 9 is a view of the arrow IX shown in FIG. 8 as a state in which the elements shown in FIG. 8 have been mounted.

On the other hand, the engaging projections 61 are joined to the top end of the center beam 51. Moreover, an engaging recess 67 for forming a joint portion in cooperation with the engaging projection 61 is formed at the top end of the center beam 51. FIG. 9 is a view IX showing a state of FIG. 8 in which the engaging projection 61 is joined to the engaging recess 67. A front portion of the engaging recess 67 has a width larger than the width of a rear portion of the engaging recess 67 in order to enable the engaging recess 67 to be joined to the engaging projection 61. As a result, inclined surfaces 69 and 71 corresponding to the inclined surfaces 63 and 65 are formed in center beam 51. As shown in FIG. 7, a front surface 83 of the engaging projections 61 is positioned slightly more inner than the front surface of the center beam 51 in a state in which the engaging projection 61 is joined to the engaging recess 67. However, the front surface 83 is substantially flush with the front surface of the center beam 51.

Figure 10:
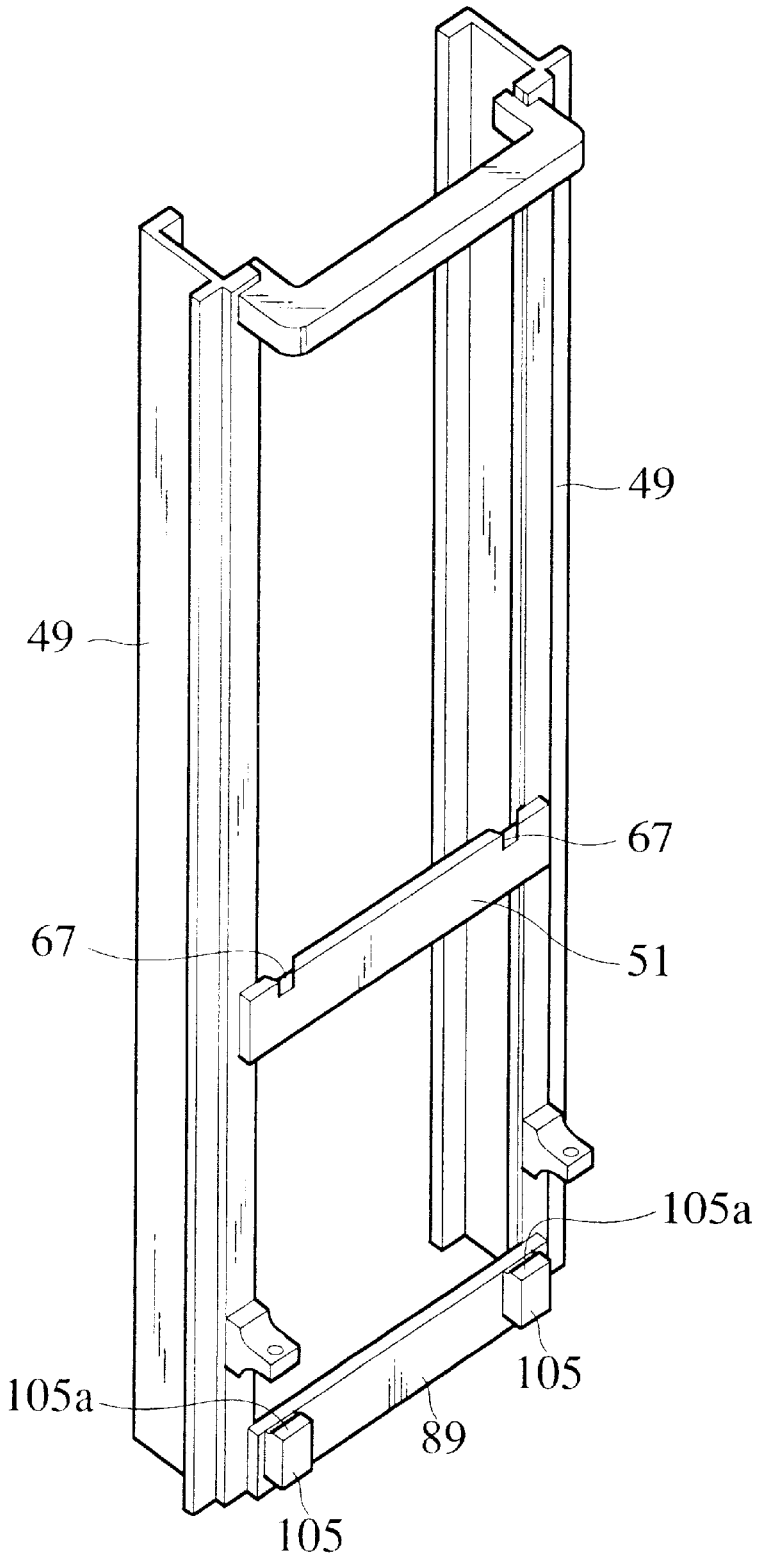
FIG. 10 is a perspective view showing the inner masts of the forklift truck shown in FIG. 6.
Figure 11:
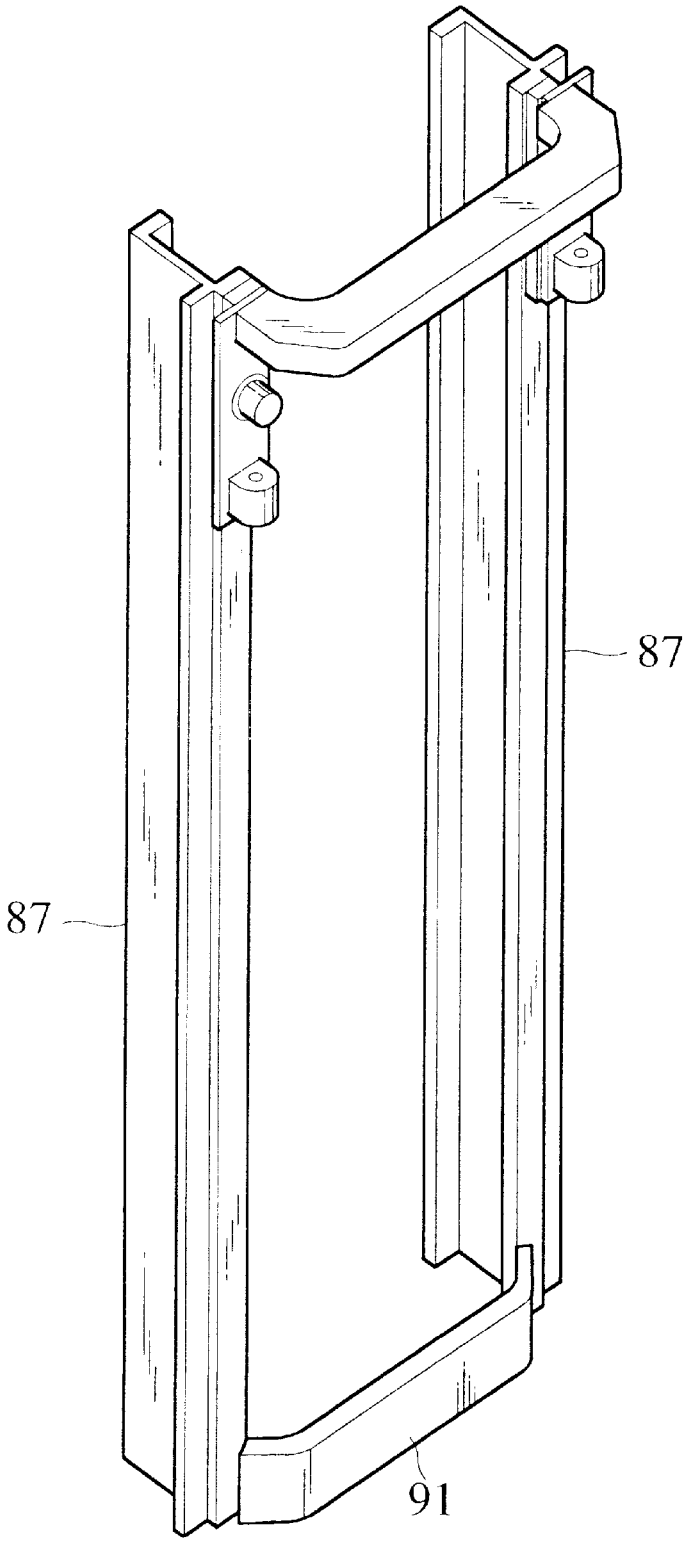
FIG. 11 is a perspective view showing the middle masts of the forklift truck shown in FIG. 6.
Figure 12:
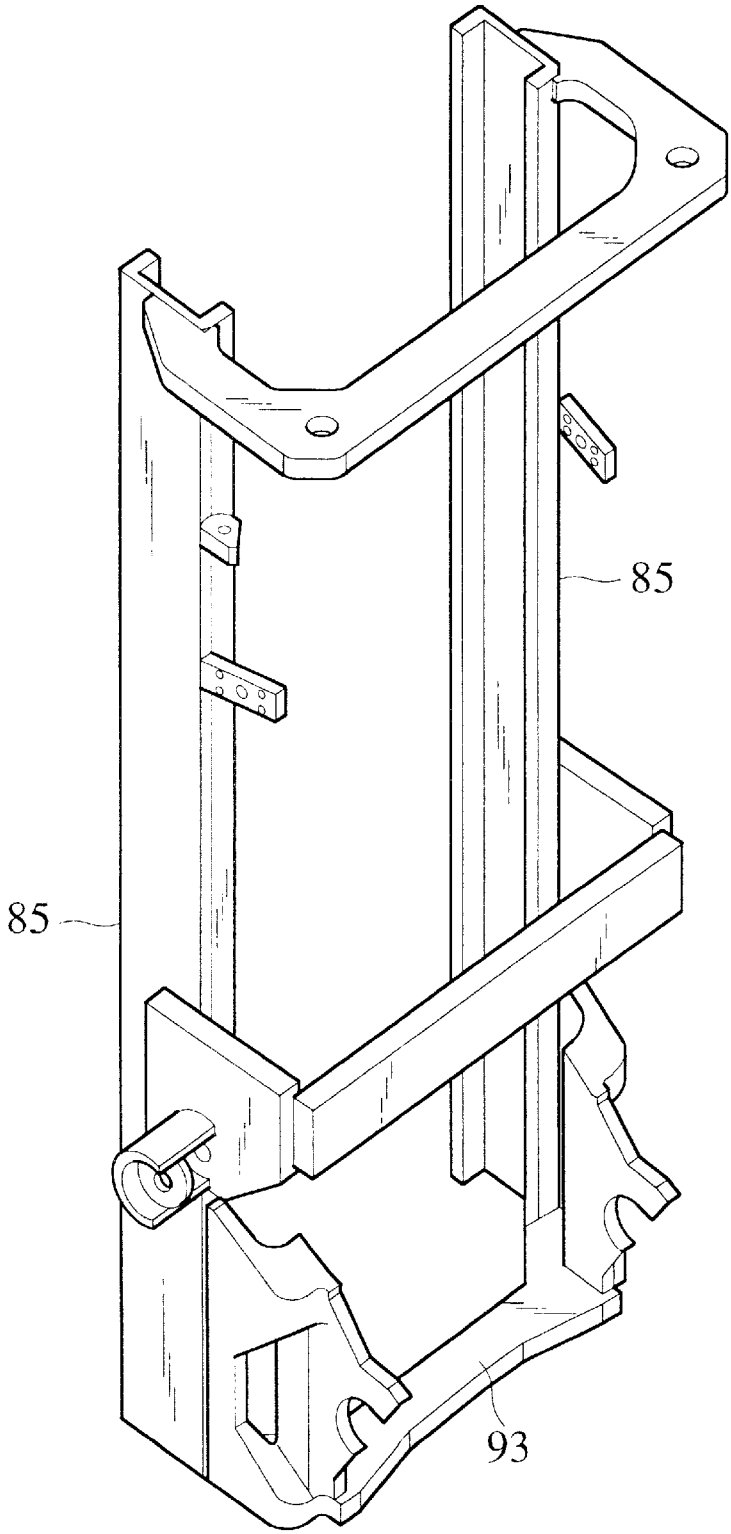
FIG. 12 is a perspective view showing the outer masts of the forklift truck shown in FIG. 6.

FIGS. 10, 11 and 12 are perspective views of the inner masts 49, middle masts 87 and outer masts 85, respectively. The middle masts 87 and outer masts 85 constitute first masts which are cooperating with the aforementioned second masts. From time to time, only the outer masts 85 constitute the first masts depending upon variety of designing of the forklift truck. A pair of the right-hand and left-hand inner masts 49, middle masts 87 and the outer masts 85 have lower ends which are connected to each other by dint of a corresponding inner-mast lower beam 89, a middle-mast lower beam 91 and an outer-mast lower beam 93.

Similarly to a conventional structure, a pair of right-hand and left-hand mast-lifting cylinders 95 for vertically moving the middle masts 87 are extended on the outer-mast lower beam 93 in the rear of the outer masts 85. On the other hand, a pair of right-hand and left-hand cargo-handling-tool lifting cylinders 53 for upwardly moving a fork 99, which is joined to the front surface of a carriage 97 and which serves as a cargo-handling tool, are disposed in the rear of the pair of right-hand and left-hand inner masts 49, the cargo-handling-tool lifting cylinders 53 being extended vertically. The carriage 97 is secured to a leading end of each of the carriage brackets 101. Rollers 103, which are arranged to be moved vertically while the rollers 103 are rotated with respect to the inner masts 49 are joined to the side surfaces of the carriage brackets 101 adjacent to the top and lower ends of the inner masts 49.

As shown in FIG. 10, cylinder supports 105 for supporting the lower ends of the cargo-handling-tool lifting cylinders 53 are joined to the rear portions of the inner-mast lower beam 89 adjacent to the inner masts 49. Projections 105*a* formed at the top ends of the cylinder supports 105 upwards project over the inner-mast lower beam 89. On the other hand, grooves (not shown) each extending in the widthwise direction of the forklift truck are formed at the lower ends of the cargo-handling-tool lifting cylinders 53. Projections 105*a* of the cylinder supports 105 are introduced into the grooves.

An operation for mounting the cargo-handling-tool lifting cylinders 53 of the structure for joining a cylinder for lifting a cargo-handling tool on the inner masts 49 will now be described. In a state in which the cargo-handling-tool lifting cylinders 53 have been inserted into the insertion holes 57 of the brackets 55, the grooves at the lower ends of the cargo-handling-tool lifting cylinders 53 are introduced into the projections 105*a* of the cylinder supports 105 shown in FIG. 10. Simultaneously, the engaging projections 61 of the brackets 55 are received by the engaging recesses 67 of the center beam 51.

The operation for mounting the cargo-handling-tool lifting cylinders 53 on the inner masts 49 is performed by joining the engaging projections 61 provided for the center beam 51 for supporting the cargo-handling-tool lifting cylinders 53 to the engaging recesses 67 provided for the center beam 51 as described above. Therefore, the operation can easily be performed. Thus, the workability in the assembling operation can be improved.

As shown in FIG. 6, the cargo-handling-tool lifting cylinders 53 are disposed in the rear of the inner masts 49. Specifically, the cargo-handling-tool lifting cylinders 53 are disposed in the rear of the carriage brackets 101. Since the cargo-handling-tool lifting cylinders 53 are not disposed between the carriage brackets 101, satisfactory forward visibility is permitted between the carriage brackets 101. The joint portion, which includes the engaging projections 61 and the engaging recesses 67, is formed in front of the cargo-handling-tool lifting cylinders 53. Moreover, the front surfaces 83 of the engaging projections 61 are formed at positions somewhat inward as compared with the front surface of the center beam 51 and a substantially flush surface is formed. Therefore, the brackets 55 can be joined to the center beam 51 at further outer positions in the widthwise direction of the forklift truck (at a left-hand position in FIG. 7). Since the cargo-handling-tool lifting cylinders 53 can be disposed at outer positions in the widthwise direction of the forklift truck, the forward visibility can furthermore be improved.

Since this embodiment is not required to secure the brackets 55 with bolts from forward positions of the forklift truck in order to prevent interference with the cargo-handling-tool lifting cylinders 53, the cargo-handling-tool lifting cylinders 53 can be disposed more forwards so as to dispose the cargo-handling-tool lifting cylinders 53 adjacent to the center beam 51. Therefore, the front overhang can be reduced. Since fixing bolts are not required, any bolt fixing portion is not required for the brackets 55. Thus, the widthwise length can be reduced and therefore the forward visibility can be improved.

Figure 13:
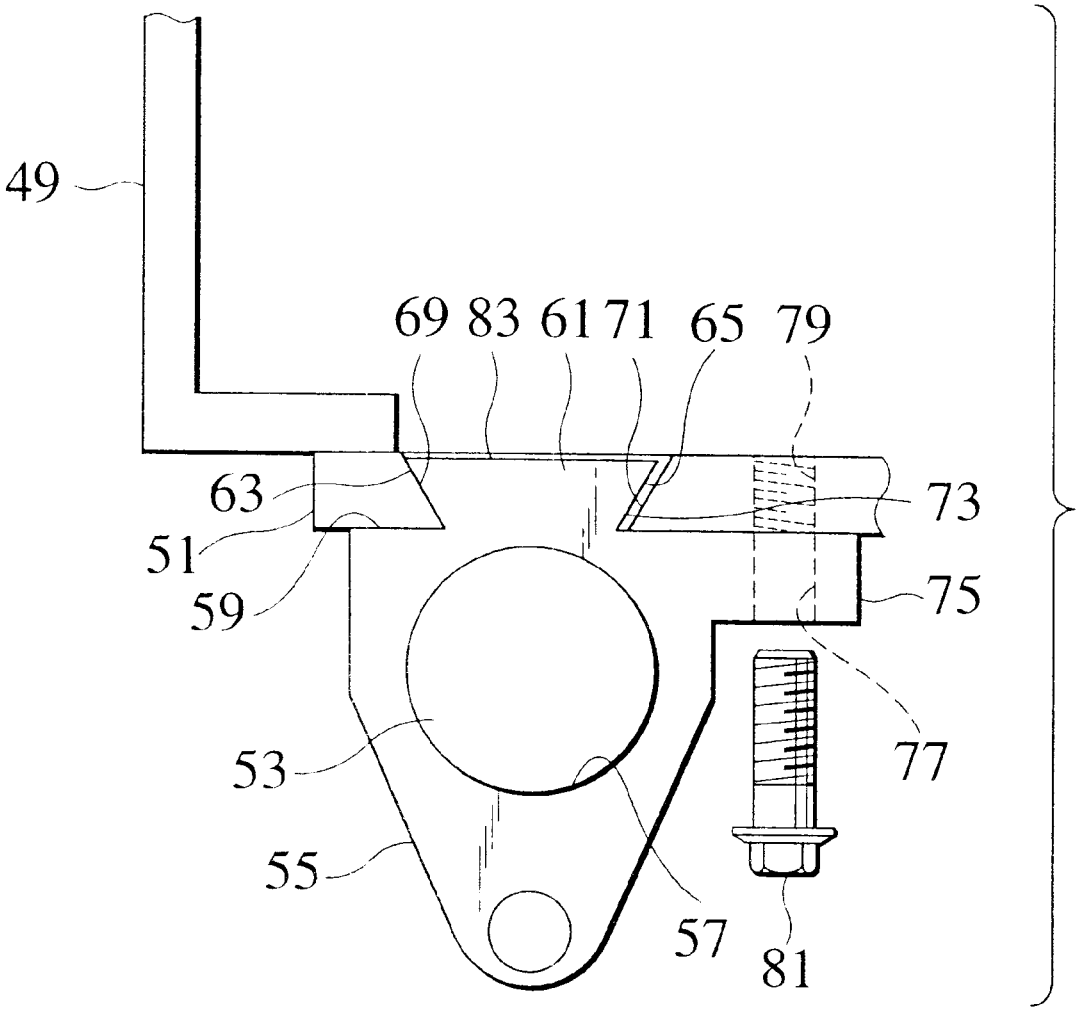
FIG. 13 is a plan view showing an essential portion of a modification of the first embodiment shown in FIG. 6.

FIG. 13 shows a modification of the first embodiment. In this embodiment, the bracket 55 is secured toward the center beam 51 with a bolt 81. A flange 75 projecting to the central portion of the forklift truck is formed on the side surface of the brackets 55 adjacent to the central portion of the forklift truck, that is, on a right-hand side surface shown in FIG. 13. The flange 75 has a bolt insertion hole 77, while a threaded hole 79 corresponding to the bolt insertion hole 77 is formed in the center beam 51.

The distance between the inclined surfaces 63 and 65 of each of the engaging projections 61 is shorter than the distance between the inclined surfaces 69 and 71 of the engaging recess 67. As a result, a gap 73 is formed between the engaging projection 61 and the engaging recess 67. In a state in which the bolt 81 has been inserted into the bolt insertion hole 77 and received by the threaded hole 79, the inclined surfaces 63 and 69 in the outer portion of the forklift truck are in close contact with each other.

In the embodiment shown in FIG. 13, the inclined surface 63 of the engaging projections 61 which are formed at an outer position in the widthwise direction of the forklift truck, are located in a state in which the inclined surface 63 is in close contact with the inclined surface 69 of the engaging recess 67. In the foregoing state, the bolts 81 are screwed in so that the brackets 55 are secured to the center beam 51. In this case, a play is permitted between the engaging projection 61 and the engaging recess 67 by dint of the gap 73. Therefore, the joining operation can easily be performed. Moreover, the brackets 55 can reliably be secured to the center beam 51 by the bolts 81.

Figure 14:
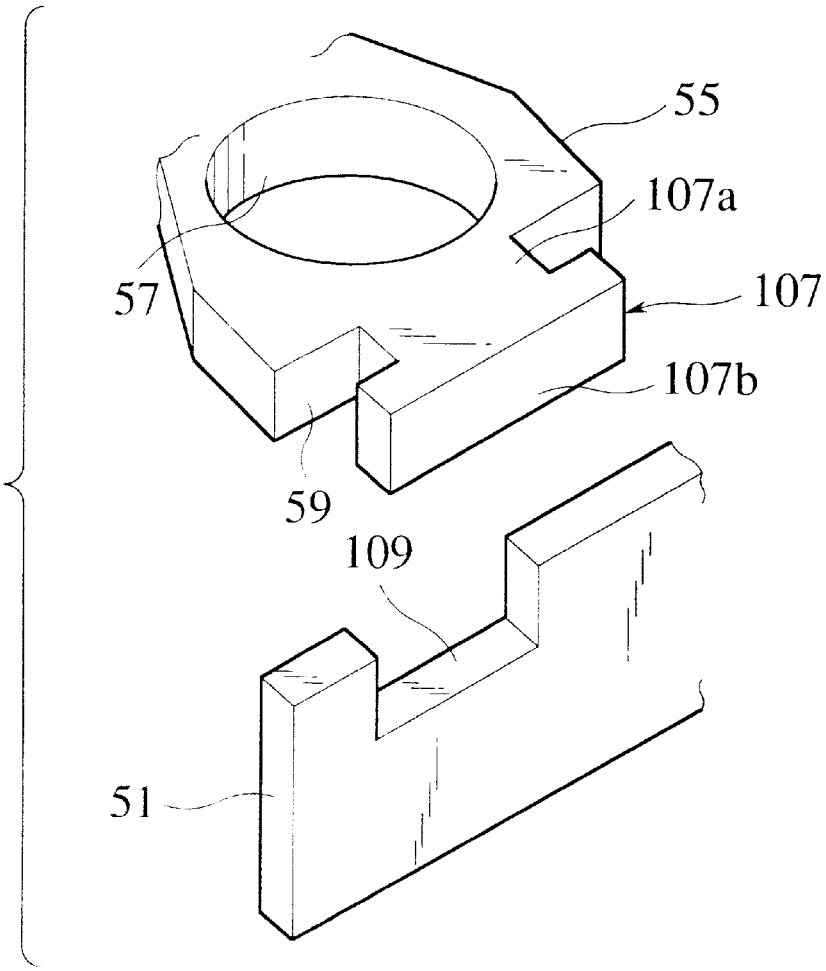
FIG. 14 is an exploded perspective view showing an essential portion of a second embodiment of the present invention.

FIG. 14 is an exploded perspective view showing an essential portion of a second embodiment of the present invention, that is, a joint portion in which the brackets 55 for supporting the cargo-handling-tool lifting cylinders 53 and the center beam 51 are joined to each other. Also the joint portion according to this embodiment has a structure in which a joining projection 107 is formed on the end surfaces 59 of each of the brackets 55. Moreover, a joining recess 109 is formed in the upper surface of the center beam 51. The joining projection 107 has a neck portion 107*a* which is introduced into the joining recess 109 and an engaging projection 107*b* formed in front of the neck portion 107*a* projecting horizontally in front of the center beam 51. When the neck portion 107*a* is joined to the joining recess 109, the end surface 59 is brought into contact with the center beam 51. Since the engaging projection 107*b* is positioned at a position opposite to the contact portion, the brackets 55 can be joined to the center beam 51.

In the foregoing case, the width of the engaging projection 107*b* is substantially the same as the outer diameter of the cargo-handling-tool lifting cylinder 53. Moreover, the joint portions are formed in front of the cargo-handling-tool lifting cylinders 53. Therefore, the brackets 55, despite projecting forward can be disposed at outer positions in the widthwise direction of the forklift truck. Thus, satisfactory forward visibility can be realized. Since the cargo-handling-tool lifting cylinders 53 can be disposed adjacently at positions adjacent to the center beam 51, the front overhang can be reduced.

Figure 15:
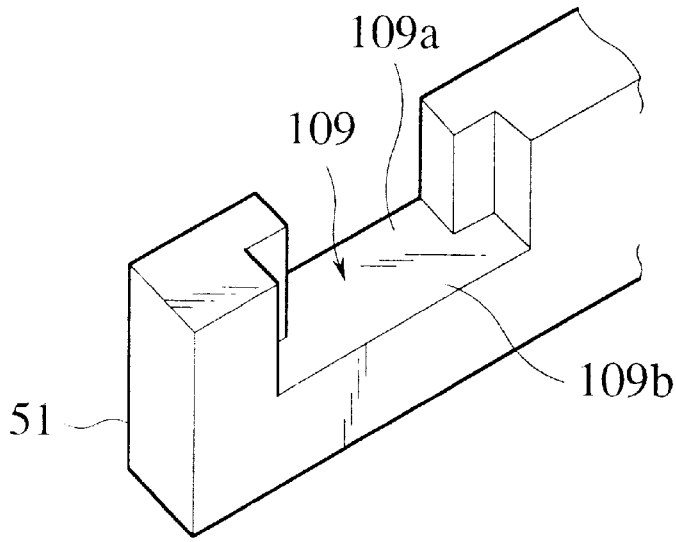
FIG. 15 is a perspective view showing an essential portion a center beam according to a modification of the embodiment shown FIG. 14.

FIG. 15 shows a modification of the embodiment shown in FIG. 14. In this modification, the joining recess 109 of the center beam 51 is provided with a neck-portion receiving portion 109*a* into which the neck portion 107*a* is introduced and an engaging-projection receiving portion 109*b* into which the engaging projection 107*b* is introduced. In this modification, the engaging projection 107*b* is introduced into the engaging-projection receiving portion 109*b* of the center beam 51 so that the engaging projection 107*b* does not project forwardly over the center beam 51. Therefore, the brackets 55 can be disposed at further outer positions as compared with the structure shown in FIG. 13.

Figure 16:
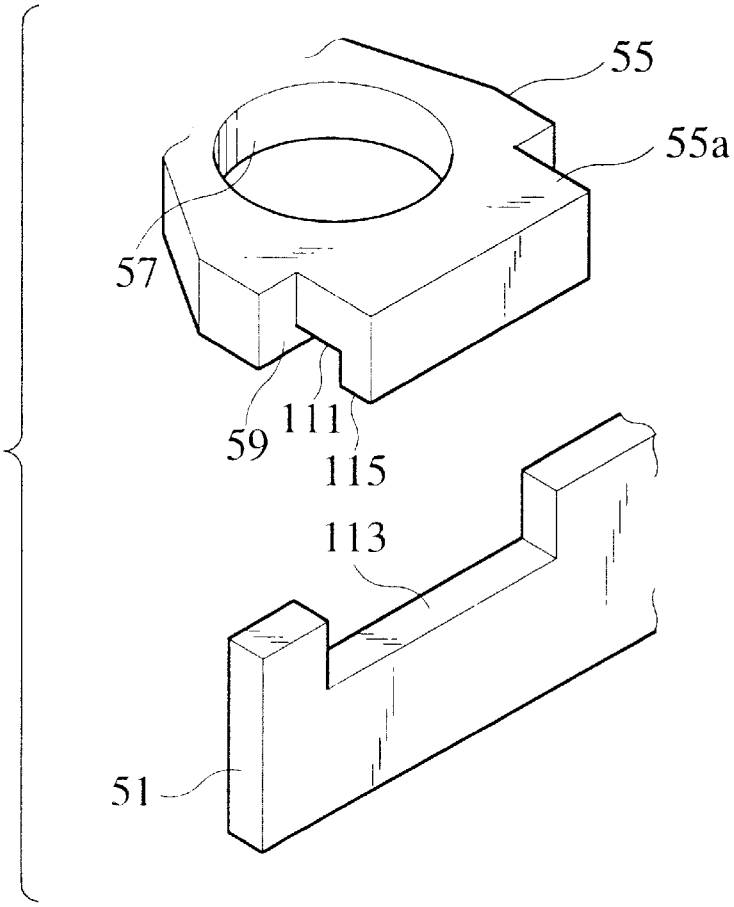
FIG. 16 is an exploded perspective view showing an essential portion of a third embodiment of the present invention.

FIG. 16 shows a third embodiment of the present invention. In this embodiment, a joining groove 111 extending in the widthwise direction of the forklift truck is formed in the lower surface of a projection portion 55*a* provided for the front end surfaces 59 of the bracket 55. A recess 113 corresponding to the joining groove 111 is formed in the upper end portion of the center beam 51. Thus, a joining portion is constituted. When the joining groove 111 and the recess 113 are joined to each other, the end surfaces 59 of the bracket 55 are brought into contact with the center beam 51. The engaging portion 115 disposed in front of the joining groove 111 and projecting downwards is positioned in front of the center beam 51. Thus, the brackets 55 are joined to the center beam 51. The widthwise size of the projection portion 55*a* of the bracket 55 provided with the joining groove 111 is substantially the same as the outer diameter of the cargo-handling-tool lifting cylinder 53. Thus, a joining portion is formed in front of the cargohandling-tool lifting cylinder 53. As a result, the brackets 55 can be disposed at further outer positions with respect to the center beam 51.

The embodiment shown in FIG. 16 may be arranged such that the recess 113 of the center beam 51 is omitted.

Figure 17:
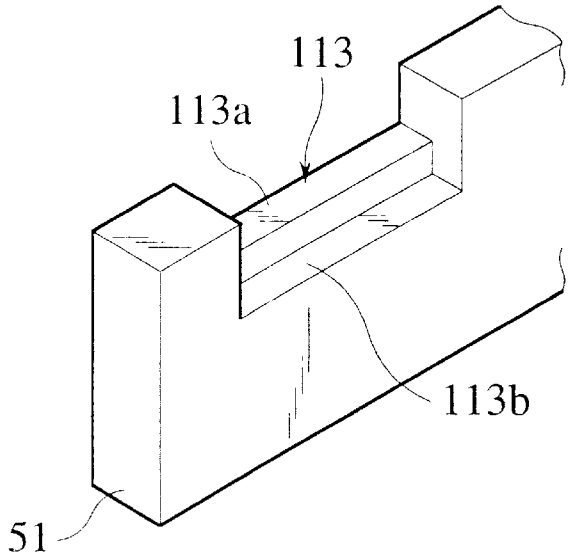
FIG. 17 is a perspective view showing an essential portion of the center beam according to a modification of the embodiment shown in FIG. 16.

FIG. 17 shows a modification of the embodiment shown in FIG. 16. In this modification, the recess 113 has a joining-groove receiving portion 113*a* into which the joining groove 111 is introduced and a notch 113*b* formed in front of the joining-groove receiving portion 113*a*. Since the engaging portion 115 of the bracket 55 is introduced into the notch 113*b*, forward projection of the projection portion 55*a* of the brackets 55 over the center beam 51 can be prevented. As a result, the cargo-handling-tool lifting cylinders 53 can be disposed at further outer positions in the widthwise direction of the forklift truck as compared with the structure shown in FIG. 16.

Figure 18:
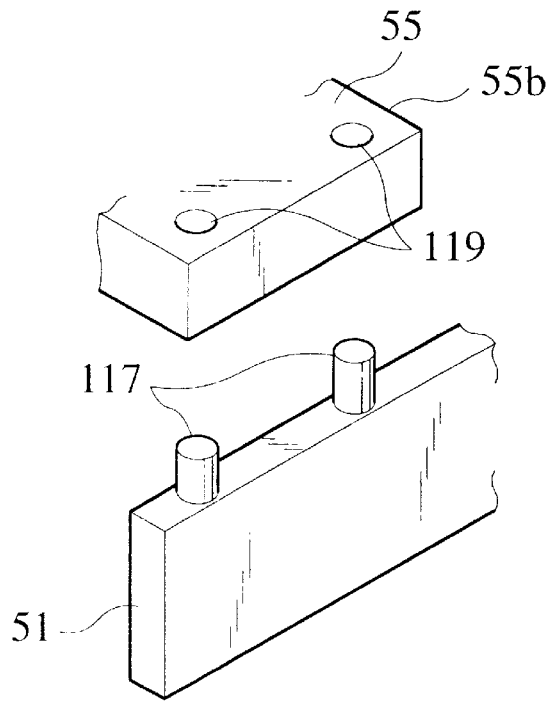
FIG. 18 is an exploded perspective view showing an essential portion of a fourth embodiment of the present invention.

FIG. 18 shows a fourth embodiment of the present invention. In this embodiment, a pair of joining pins 117 are disposed at the top end of the center beam 51. Moreover, a joining hole 119 into which the joining pin 117 is inserted is formed in the upper surface of the bracket 55. Thus, a joining portion is constituted. A front end 55*b* of the brackets 55 provided with the joining hole 119 has a widthwise size with is substantially the same as the outer diameter of the cargo-handling-tool lifting cylinder 53. Thus, the joint portion is formed at a position in front of the cargo-handling-tool lifting cylinder 53. As a result, the brackets 55 can be disposed at further outer positions in the widthwise direction of the forklift truck with respect to the center beam 51.

The embodiment shown in FIG. 18 may be arranged such that a bolt employed in place of the pin 117 is screwed in the top end of the center beam 51. Moreover, a receiving hole for receiving the head of the bolt may be formed. The joining pin 117 may be provided for the brackets 55, while the joining hole 119 may be provided for the center beam 51.

Figure 19:
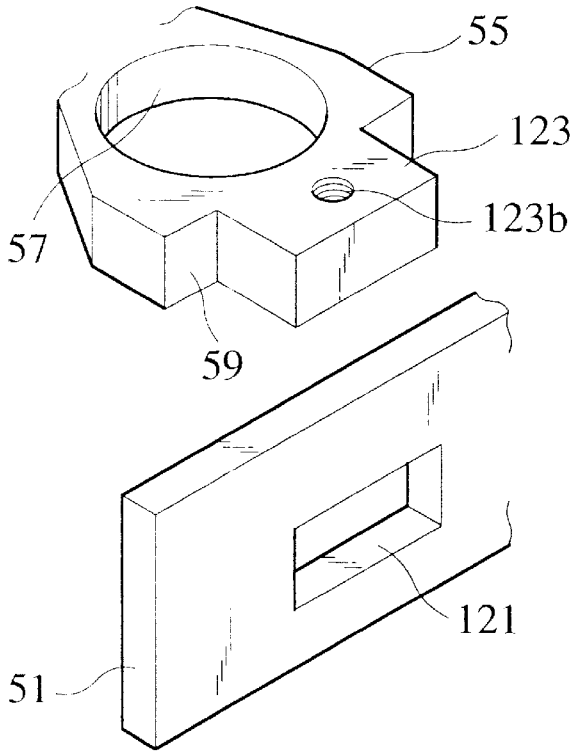
FIG. 19 is an exploded perspective view showing an essential portion of a fifth embodiment of the present invention.
Figure 20:
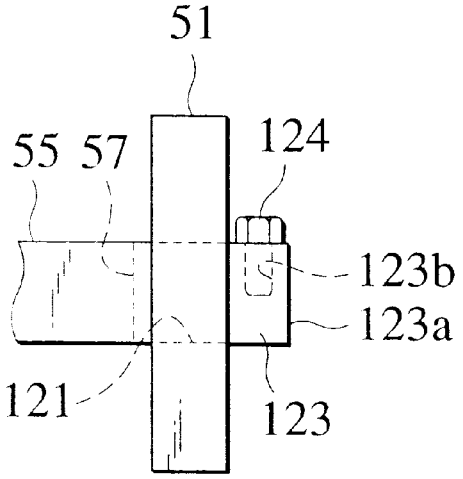
FIG. 20 is a side view showing a state in which the elements shown in FIG. 19 have been mounted.

FIGS. 19 and 20 show a fifth embodiment of the present invention. In this embodiment, a rectangular through hole 121 is provided for the center beam 51. Moreover, an insertion projection 123 arranged to be inserted into the through hole 121 is provided for the brackets 55. In a state in which the insertion projection 123 has been inserted into the through hole 121, the insertion projection 123 has a projection 123*a* projecting forwards over the center beam 51 as shown in FIG. 20. A bolt 124 serving as the engaging member is, from an upper position, screwed in a threaded hole 123*b* formed in the projection 123*a*, the treaded hole 123*b* serving as the engaging hole. Since the head of the bolt 124 appears outside, separation of the insertion projection 123 from the through hole 121 can be prevented. Thus, the brackets 55 can be secured to the center beam 51. At this time, the end surfaces 59 of the brackets 55 are brought into contact with the center beam 51.

The width of the insertion projection 123 is substantially the same as the outer diameter of the cargo-handling-tool lifting cylinder 53. Thus, the joining portion is formed in front of the cargo-handling-tool lifting cylinders 53. As a result, the brackets 55 can be disposed at further outer positions with respect to the center beam 51.

In the embodiment shown in FIG. 19 and 20, a pin having a head may be employed in place of the bolt 124, the pin being inserted into a pin insertion hole formed in place of the threaded hole 123*b*.

Figure 21:
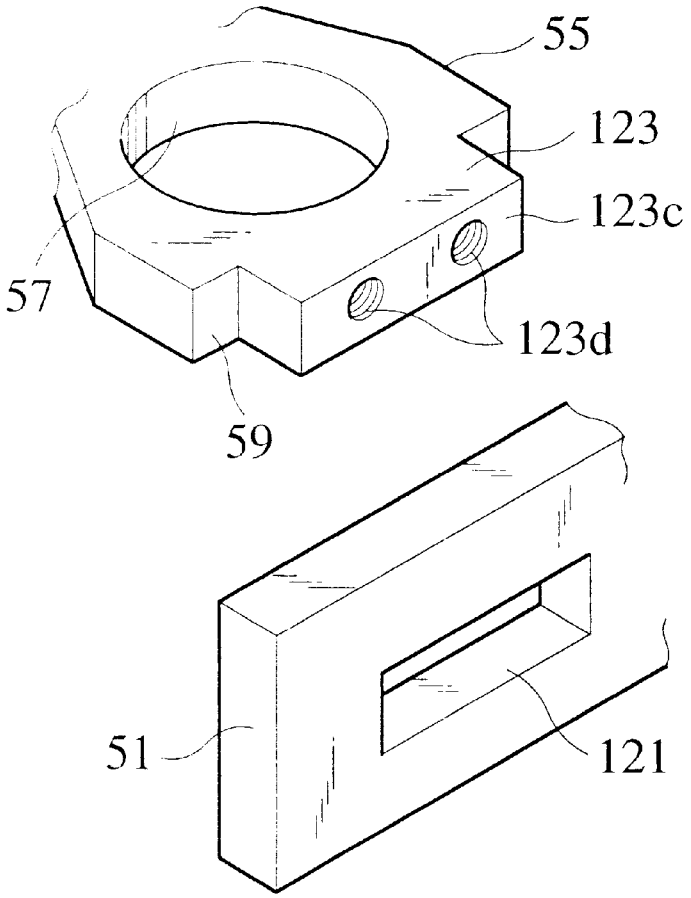
FIG. 21 is an exploded perspective view showing a sixth embodiment of the present invention.
Figure 22:
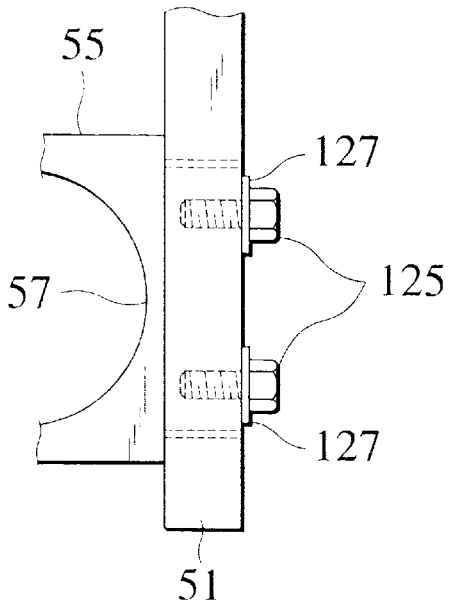
FIG. 22 is a plan view showing a state in which the elements shown in FIG. 21 have been mounted.
Figure 23:
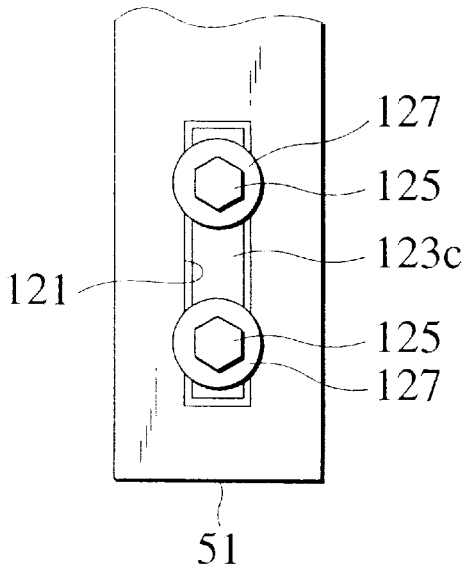
FIG. 23 is a right-hand side view of FIG. 22.

FIGS. 21 to 23 show a sixth embodiment of the present invention. This embodiment has a structure similar to that shown in FIG. 19 in which a through hole 121 is provided for the center beam 51; and an insertion projection, which is inserted into the through hole 121, is provided for the bracket 55. The insertion projection 123 according to this embodiment has a front surface 123*c* which does not forwards project over the front surface of the center beam 51. The front surface 123*c* is substantially flush with the foregoing front surface of the center beam 51. As shown in FIG. 22, which is a plan view showing an assembled state, and FIG. 23, which is a right-hand side view of FIG. 22, bolts 125 are screwed in two threaded holes 123*d* formed in the front surface of the 123*c* through washers 127 as intermediators for preventing separation.

In this embodiment, the bolts 125 are screwed in at front positions of the forklift truck. When the pitch between the two bolts 125 is shortened, the brackets 55 can be disposed at further outer positions in the widthwise direction of the forklift truck with respect to the center beam 51. Even if the pitch between the bolts 125 is shortened and thus the bolts are disposed in front of the cargo-handling-tool lifting cylinders 53, the leading end of the threaded portion of each of the bolt 125 can be accommodated in the insertion projection 123 of the bracket 55. Therefore, interference with the cargo-handling-tool lifting cylinders 53 can be prevented. Thus, the cargo-handling-tool lifting cylinders 53 can be disposed further adjacently to the center beam 51. Thus, the front overhang can be reduced without any problem.

Figure 24:
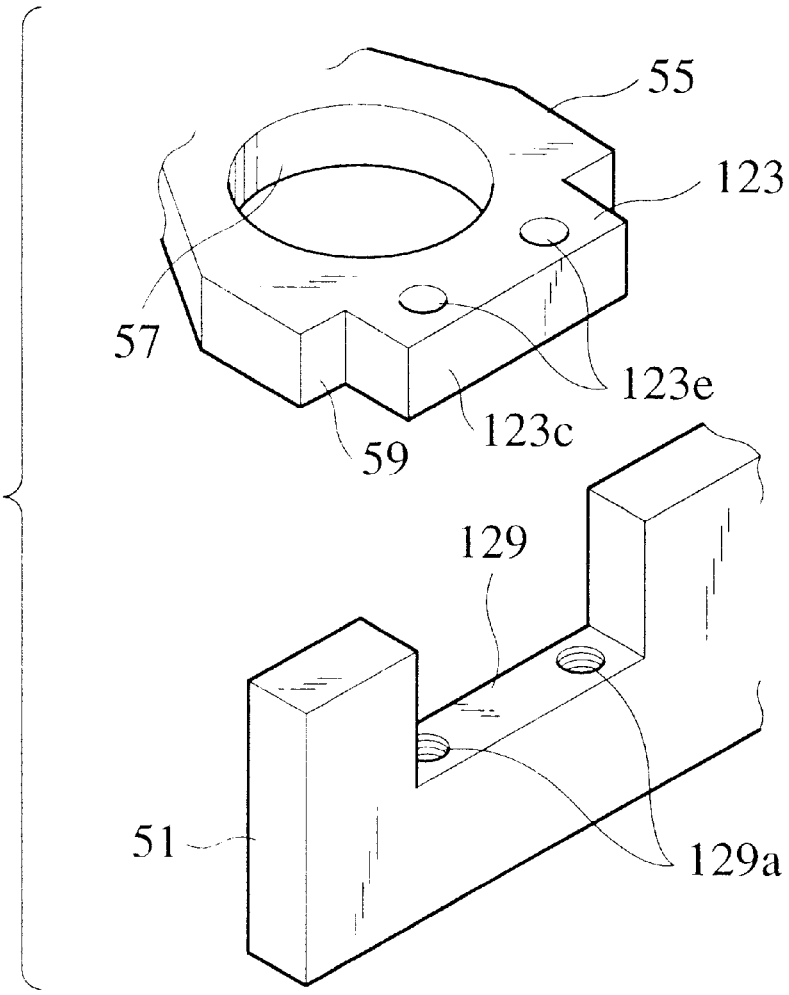
FIG. 24 is an exploded perspective view showing an essential portion of a seventh embodiment of the present invention.
Figure 25:
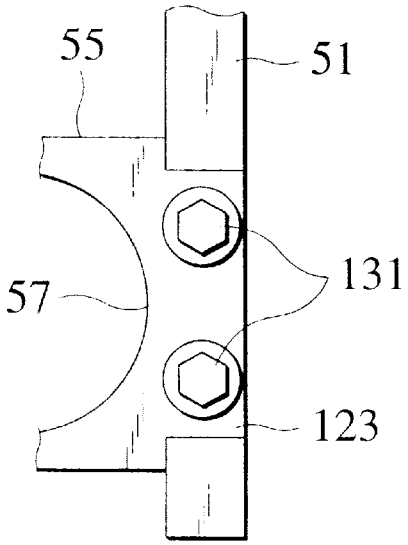
FIG. 25 is a plan view showing a state in which the elements shown in FIG. 24 have been mounted.
Figure 26:
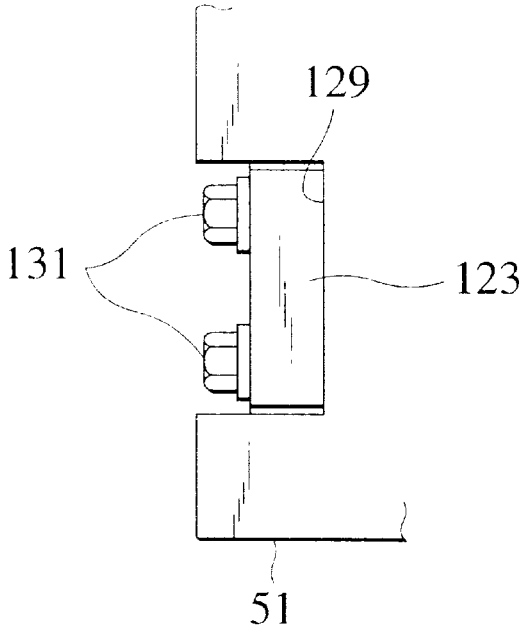
FIG. 26 is a right-hand side view of FIG. 25.

FIGS. 24 to 26 show a seventh embodiment of the present invention. In this embodiment, the bracket 55 is provided with an insertion projection 123 similar to that according to the embodiment shown in FIG. 21. On the other hand, a recess 129 into which the insertion projection 123 is inserted from an upper position is provided for the center beam 51. The insertion projection 123 has two bolt insertion holes 123*e* to vertically penetrate the insertion projection 123. The recess 129 has threaded holes 129*a* corresponding to the bolt insertion holes 123*e*.

As shown in FIG. 25, which is a plan view showing an assembled state, and FIG. 26, which is a right-hand side view, in a state in which the insertion projection 123 has been inserted into the recess 129, the two bolts 131 are screwed in. Thus, the brackets 55 can be secured to the center beam 51. At this time, the end surfaces 59 of the brackets 55 are brought into contact with the center beam 51. The front surface 123*c* of the insertion projection 123 is substantially flush with the front surface of the center beam 51.

Similarly to the embodiment shown in FIG. 13, the second and following embodiments may be structured such that bolts may be employed which are screwed in from the outer portions of the brackets 55.

Figure 27:
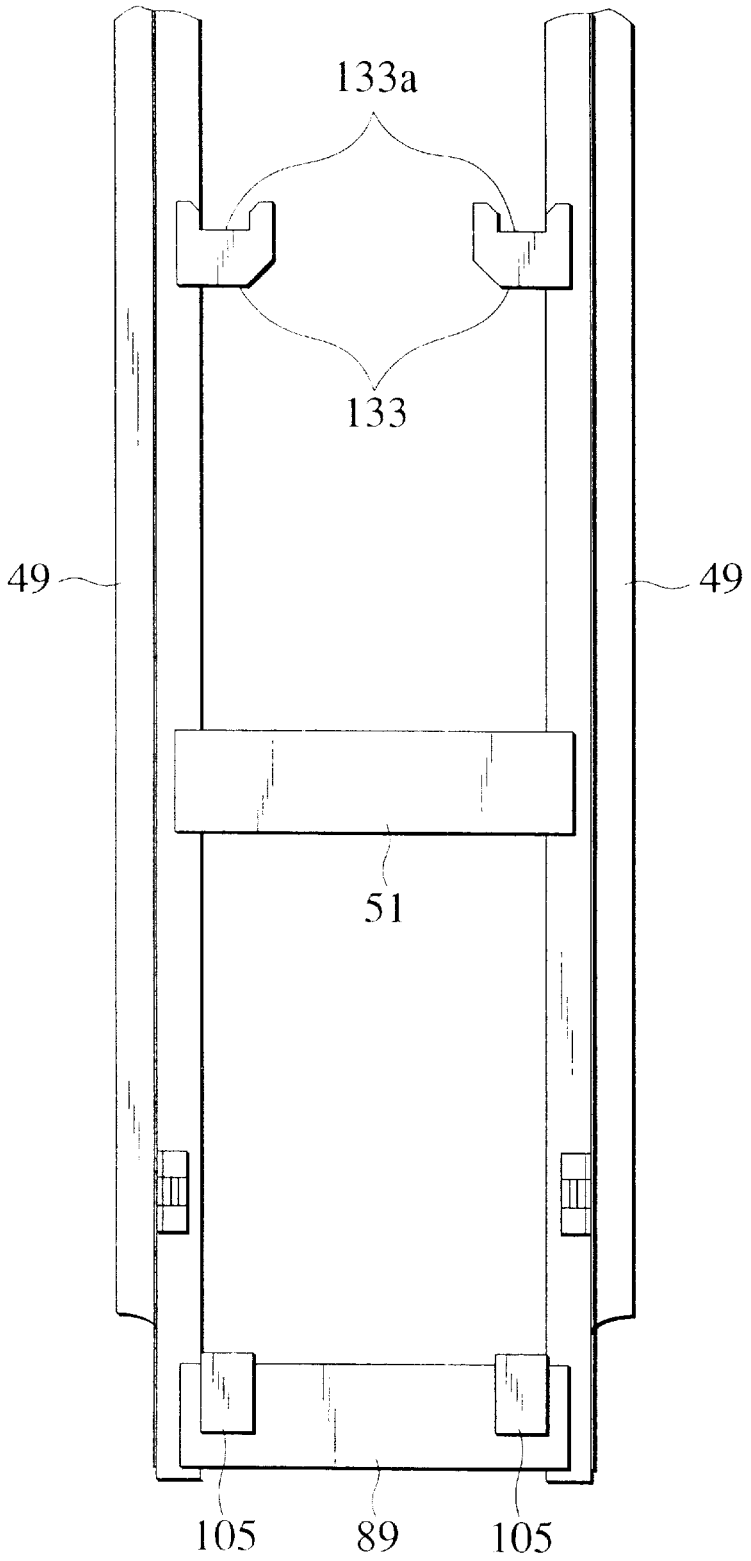
FIG. 27 is front view showing an eighth embodiment of the present invention when viewed from a position in the rear of the inner masts.

FIG. 27 shows an example in which a fixing member 133 having an engaging recess 133*a*, to which the engaging projection 61 of the bracket 55 for supporting the cargo-handling-tool lifting cylinders 53 shown in FIG. 6 is joined, is joined to a position upper than the center beam 51 for connecting the right and left inner masts 49.

Although the lifting mechanisms each having the three pairs of the masts have been described in the foregoing embodiments, the present invention may be applied to a lifting mechanism having two pairs of masts, that is, having no middle mast. In this case, the outer masts are first masts.

As specifically described in the above embodiments, according to a first aspect of the present invention, there is provided a structure to join a cylinder lifting a cargo-handling tool, comprising: a pair of right-hand and left-hand first masts provided on a forklift truck; a pair of right-hand and left-hand second masts vertically moved by mast lifting cylinder disposed adjacent to the first masts; a cargo-handling tool vertically moved with respect to the pair of the right-hand and left-hand second masts by cargo-handling-tool lifting cylinders disposed adjacent to the second masts: a connecting member connecting the pair of the second masts to each other in the rear portion of the forklift truck; and brackets joining the cargo-handling-tool lifting cylinders to the connecting member, wherein the cargo-handling-tool lifting cylinders are disposed in the rear of the pair of the second masts; ends of the brackets are joined and secured to the connecting member through joint portions in a state in which the cargo-handling-tool lifting cylinders are supported by the brackets at adjacent positions by the connecting member; and the joint portions are formed in front of the cargo-handling-tool lifting cylinders.

The structure for joining a cylinder for lifting a cargo-handling tool having the above-mentioned structure is arranged such that the front ends of the brackets provided for the cargo-handling-tool lifting cylinders disposed in the rear of the second masts are secured to the connecting member through the joint portions without any bolt. Moreover, the joint portions are formed in front of the cargo-handling-tool lifting cylinders. Therefore, the necessity of preventing interference of the heads of the bolts with the second masts can be eliminated when the cargo-handling-tool lifting cylinders are disposed at outer positions. Thus, the forward visibility can be improved.

Even if the cargo-handling-tool lifting cylinders are disposed at adjacent positions by the connecting member to reduce the front overhang, interference with the leading ends of the bolts can be prevented. Therefor, a necessity of disposing the cargo-handling-tool lifting cylinders adjacent to the central portion in the widthwise direction of the forklift truck can be eliminated. Thus, deterioration in the forward visibility can be prevented. Since the brackets do not require bolt fixing portions, the length in the widthwise direction of the forklift truck can be reduced. Thus, also the foregoing structure enables the forward visibility to be improved.

According to a second aspect of the present invention, as it depends from the first aspect, wherein joining projections projecting forwards are formed on end surfaces of the brackets which are in contact with a rear portion of the connecting member; the width of the leading end portion of each of the joining projections is larger than the width of the base end portion of each of the joining projections; and joining recesses receiving the joining projections are formed in the upper end of the connecting member.

Since the above-mentioned structure has arrangements that the joining projections are joined to the joining recesses from an upper position and that the width of the front portion of the joining projection is larger than the width of the rear portion of the same, rearward movement of the brackets with respect to the connecting member can be prevented. Since the front end surfaces of the brackets are in contact with the connecting member, also forward movement with respect to the connecting member can be prevented. Thus, the brackets can be secured to the connecting member.

According to a third aspect of the present invention, as it depends from the first aspect, wherein each of side surfaces of the joining projections is formed by an inclined surface which connects to the leading end portion and to the base end portion of each of the joining projection; and front surfaces of the joining projections are flush with the front surface of the connecting member in a state in which the joining projections are joined to the joining recesses.

Since the above-mentioned is arranged such that the front surfaces of the joining projections do not forward project over the connecting member to positions at which the second masts are disposed, the brackets for supporting the cargo-handling-tool lifting cylinder can easily be disposed at outer positions. Therefore, the forward visibility can be improved.

According to a fourth aspect of the present invention, as it depends from one aspect among the first aspect to the third aspect, wherein the brackets are provided with flanges; and the brackets are secured to the connecting member with bolts through the flanges.

The above-mentioned structure enables the brackets for supporting the cargo-handling-tool lifting cylinders to reliably be secured to the brackets.

According to a fifth aspect of the present invention, as it depends from the fourth aspect, wherein a gap is formed between one of the inclined surfaces and a side surface of the joining recesses opposite to the inclined surface in a state in which the joining projections and the joining recesses are joined; another gap is formed between the other of the inclined surfaces and another side surface of the joining recesses opposite to the inclined surface in a state in which the joining projections and the joining recesses are joined; and the bolt is screwed in a state in which one of the inclined surfaces and one of the side surfaces of the joining recess are in close contact with each other.

Since above-mentioned structure is arranged such that the gap is formed between each of the joining projections and each of the joining recesses, a joining operation can easily be performed. Since the two side surface of either of the joining projection and either of the joining recess are in close contact with each other, the brackets can be located with respect to the connecting member.

According to a sixth aspect of the present invention, as it depends from the second aspect, wherein each of the joining projections has a neck portion which is received by the joining recess and an engaging projection locating in front of the neck portion and projecting in the widthwise direction of the forklift truck.

Since the above-mentioned structure is arranged such that the neck portion is received by the joining recess, the engaging projection is disposed in front of the connecting member so that the bracket is secured to the connecting member. Since the width of the engaging projection disposed in front of the connecting member is smaller than that of a portion for supporting the cargo-handling-tool lifting cylinder, interference of each of the engaging projection with the second mast can be prevented.

According to a seventh aspect of the present invention, as it depends from the sixth aspect, wherein each of the joining recesses has a portion for receiving the engaging projection of the joining projection.

The above-mentioned structure is arranged such that the engaging projection is received in the portion for receiving the engaging projection provided for the joining recess at the upper end of the connecting member. Thus, the engaging projection does not forward project over the connecting member and the brackets for supporting cargo-handling-tool lifting cylinders can easily be disposed at outer positions in the widthwise direction of the forklift truck. Therefore, the forward visibility can furthermore be improved.

According to an eight aspect of the present invention, as it depends from the first aspect, wherein the bracket is formed with an engaging groove extending in the widthwise direction of the forklift truck to receive the top end of the connecting member at a leading end of a lower surface of the bracket.

Since the above-mentioned structure is arranged such that the top end of the connecting member is received in the engaging groove of each of the brackets, the brackets can be secured to the connecting member in a state in which the brackets are disposed at outer positions.

According to a ninth aspect of the present invention, as it depends from the eighth aspect, wherein the top end of the connecting member is formed with a recess to be received in the engaging groove.

Since the above-mentioned structure is arranged such that the engaging groove of the bracket and the recesses of the connecting member are mutually engaged to each other, each bracket can be engaged such that the upper surface of each bracket is flush with the upper surface of the connecting member. Therefore, a further reliable state of engagement can be realized.

According to a tenth aspect of the present invention, as it depends from the eighth or the ninth aspect, wherein the top end of the connecting member has a notch in a front portion thereof to cause a rear portion of the connecting member to be introduced into the engaging groove.

Since the above-mentioned structure is arranged such that the rear portion of the top end of the connecting member is introduced into the engaging groove, a portion of the bracket more forward than the engaging groove is introduced into the notch. As a result, undesirable projection of the leading end of the bracket more forward than the connecting member can be prevented. Therefore, the brackets for supporting the cargo-handling-tool lifting cylinders can easily be disposed at outer positions in the widthwise direction of the forklift truck.

According to a eleventh aspect of the present invention, as it depends from the first aspect, wherein an engaging pin is provided on one end of the lower surface of a front end of the bracket and the upper surface of the connecting member; and an engaging opening receiving the engaging pin is provided on the other end of the lower and the upper surfaces.

As a result of the above-mentioned structure in which the engaging pin is received in the engaging opening, the brackets can be secured to the connecting member in a state in which the brackets are disposed at outer positions in the widthwise direction of the forklift truck.

According to a twelfth aspect of the present invention, as it depends from the first aspect, wherein the lower surface of a front end of the bracket is brought into contact with an upper surface of the connecting member; and the bracket is secured to the connecting member by a bolt which is inserted and fasten from the upper portion of the bracket.

As a result of the above-mentioned structure in which the lower surface of the front end of each bracket is brought into contact with the upper surface of the connecting member and the bolt is, in the foregoing structure, screwed in from the upper portion of the bracket, the brackets can be secured to the connecting member.

According to a thirteenth aspect of the present invention, as it depends from the twelfth aspect, wherein the upper surface of the connecting member with which the lower surface of the bracket is brought into contact has a recess into which the lower surface of the bracket is introduced.

As a result of the above-mentioned structure in which the lower surface of the bracket is introduced into the recess formed in the upper surface of the connecting member, location can easily be performed when the bolt is screwed in. Moreover, the brackets can reliably be secured to the connecting member.

According to a fourteenth aspect of the present invention, there is provided a structure to join a cylinder lifting a cargo-handling tool, comprising: a pair of right-hand and left-hand first masts provided on a forklift truck; a pair of right-hand and left-hand second masts vertically moved by mast lifting cylinder disposed adjacent to the first masts; a cargo-handling tool vertically moved with respect to the pair of the right-hand and left-hand second masts by cargo-handling-tool lifting cylinders disposed adjacent to the second masts; a connecting member connecting the pair of the second masts to each other in the rear portion of the forklift truck; and brackets joining the cargo-handling-tool lifting cylinders to the connecting member, wherein the cargo-handling-tool lifting cylinders are disposed in the rear of the pair of the second masts; the cargo-handling-tool lifting cylinders are supported by the brackets at positions more adjacent to the connecting member; a through hole is formed in the connecting member in a longitudinal direction of the forklift truck, an insertion projection arranged to be inserted into the through hole is formed on an end surface of each of the brackets which are in contact with a rear surface of the connecting member; the insertion projection has a projecting portion which forwards projects over the connecting member in a state in which the insertion projection is inserted into the through hole; and an engaging member is inserted into an engaging opening formed in the projecting portion in such a manner that a portion of the engaging member projects over the engaging opening so that separation of the insertion projection from the through hole is prevented.

The above-mentioned structure is arranged such that the insertion projection of each bracket is inserted into the through hole of the connecting member and the engaging member is inserted into the engaging opening formed in the projecting portion forwards projecting over the connecting member. Thus, the inserted engaging member prevents separation of each bracket from the connecting member.

According to a fifteenth aspect of the present invention, there is provided a structure to join a cylinder lifting a cargo-handling tool, comprising: a pair of right-hand and left-hand first masts provided on a forklift truck; a pair of right-hand and left-hand second masts vertically moved by mast lifting cylinder disposed adjacent to the first masts; a cargo-handling tool vertically moved with respect to the pair of the right-hand and left-hand second masts by cargo-handling-tool lifting cylinders disposed adjacent to the second masts; a connecting member connecting the pair of the second masts to each other in the rear portion of the forklift truck; and brackets joining the cargo-handling-tool lifting cylinders to the connecting member, wherein the cargo-handling-tool lifting cylinders are disposed in the rear of the pair of the second masts; the cargo-handling-tool lifting cylinders are supported by the brackets at positions more adjacent to the connecting member; a through hole is formed in the connecting member in a longitudinal direction of the forklift truck; an insertion projection arranged to be inserted into the through hole is formed in an end surface of each bracket which is in contact with a rear surface of the connecting member; a front surface of the insertion projection inserted into the through hole is flush with the front surface of the connecting member; and a bolt is screwed in a threaded hole formed in the front surface so that a head of the bolt or an interposed intermediator prevents separation of the insertion projection from the through hole.

As a result of the above-mentioned structure in which the insertion projection of each bracket is inserted into the through hole of the connecting member and the bolt is screwed in the threaded hole in the front surface of the insertion projection in the foregoing state, the head of the bolt or the interposed intermediator prevents separation of each bracket from the connecting member.

While preferred embodiments of the present invention have been described using specific terms, such description is for illustrative purposes, and it is to be understood that changes and variations may be made without departing from the spirit or scope of the following claims.

What is claimed is:

1. A structure for a forklift truck comprising:

a pair of right-hand and left-hand first masts, a pair of right-hand and left-hand second masts vertically displaceably mounted adjacent to the the pair of first masts;

a cargo-handling tool disposed forward of, and vertically displaceable with respect to, the second masts;

a pair of cargo-handling-tool lift cylinders, one of each being disposed adjacent to, and rearward of, the respective one of the second masts, the cargo-handling-tool lift cylinders vertically displacing the cargo-handling tool;

a connecting member connecting the pair of the second masts to each other in a rear portion of the forklift truck, the connecting member being formed with joining recesses, each of the joining recess having inclined side surfaces; and a pair of brackets, each being mounted to the respective one of the cargo-handling-tool lift cylinders and having a joining projection and a flange, the joining projection being coupled to the joining recess of the respective connecting member at a joint and having inclined projects side surfaces corresponding to the inclined side surfaces of the respective joining recess, and the flange being connected to the connecting member with a bolt, wherein each joint is formed directly forward of the cargo-handling-tool lift cylinder, wherein gaps are formed between the corresponding inclined side surfaces of the joining recesses and the inclined projection side surfaces of the joining projections, and wherein, when each flange is connected to the connecting member with the bolt, one of the gaps is substantially eliminated reduced.

2. A structure according to claim 1, wherein each flange is located inward with respect to the bracket so that a distance between the cargo-handling-tool lift cylinders is increased.

3. A structure according to claim 1, wherein each bolt is inserted from the flange to the connecting member.

4. A structure according to claim 3, wherein each flange includes a bolt insert hole and the connecting member includes threaded holes into which the bolts are inserted.

* * * * *